US007044588B2

(12) United States Patent
Tajima et al.

(10) Patent No.: US 7,044,588 B2
(45) Date of Patent: May 16, 2006

(54) INK JET HEAD STORING STRUCTURE AND LIQUID FILLING METHOD

(75) Inventors: Hiroki Tajima, Kanagawa (JP); Yutaka Koizumi, Kanagawa (JP); Akihiro Yamanaka, Kanagawa (JP); Hiroyuki Maeda, Kanagawa (JP); Akira Goto, Kanagawa (JP); Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/147,184

(22) Filed: Jun. 8, 2005

(65) Prior Publication Data

US 2005/0225609 A1 Oct. 13, 2005

Related U.S. Application Data

(62) Division of application No. 10/078,395, filed on Feb. 21, 2002, now Pat. No. 6,945,643.

(30) Foreign Application Priority Data

Feb. 23, 2001 (JP) ..... 2001/048426
Feb. 18, 2002 (JP) ..... 2002/040129

(51) Int. Cl.
*B41J 2/175* (2006.01)

(52) U.S. Cl. ..... 347/85; 347/87
(58) Field of Classification Search ..... 347/29, 347/84, 85, 86, 87, 108
See application file for complete search history.

(56) References Cited

U.S. PATENT DOCUMENTS

| | | | | |
|---|---|---|---|---|
| 5,244,087 | A | 9/1993 | Hikake et al. | 206/701 |
| 5,815,182 | A | 9/1998 | Otis et al. | 347/85 |
| 6,062,390 | A | 5/2000 | Nakamura | 206/576 |
| 6,097,407 | A | 8/2000 | Terasawa et al. | 347/31 |
| 6,250,745 | B1 | 6/2001 | Umemura et al. | 347/86 |
| 6,945,643 | B1 * | 9/2005 | Tajima et al. | 347/87 |

FOREIGN PATENT DOCUMENTS

| | | |
|---|---|---|
| JP | 3-248849 | 11/1991 |
| JP | 7-304182 | 11/1995 |

* cited by examiner

*Primary Examiner*—Anh T. N. Vo
(74) *Attorney, Agent, or Firm*—Fitzpatrick, Cella, Harper & Scinto

(57) ABSTRACT

The present invention provides a storing structure for storing an ink jet head including a nozzle communicated with an opening for discharging liquid, a liquid storing portion for storing the liquid to be supplied to the nozzle and a liquid introduction portion for introducing the liquid into the liquid storing portion from exterior, wherein, in the ink jet head, air is housed in the liquid storing portion and the liquid is contained at least in the nozzle, and a cap unit including an elastic cap for covering an area of the opening and a liquid absorbing member disposed in the elastic cap is closely contacted with and attached, around the opening, to a face in which the opening is formed, and the liquid introduction portion is communicated with atmosphere at least when inner pressure of the liquid storing portion is increased, thereby maintaining a space within the cap unit to a wetting condition.

1 Claim, 17 Drawing Sheets

INK JET HEAD STORING STRUCTURE AND LIQUID FILLING METHOD

This application is a division of application Ser. No. 10/078,395 which was filed on Feb. 21, 2002 now U.S. Pat. No. 6,945,643, the contents of which is incorporated herein by reference.

BACKGROUND OF THE INVENTION

1. Field of the Invention

The present invention relates to a structure for storing an ink jet head for effecting recording by discharging recording liquid from a discharge port.

2. Related Background Art

Among conventional recording systems, since an ink jet recording system for effecting recording on a recording medium by discharging ink from a discharge port has less noise and can achieve a high speed recording operation with high density, such a system has widely been used recently.

A general recording apparatus having such a system includes an ink jet head for discharging the ink to form an image on the recording medium, and a conveying device for conveying the recording medium.

As the ink jet heads, there are an ink jet head in which an electrothermal converting element such as a piezo-element is provided in a nozzle communicated with a discharge port to discharge an ink droplet from the discharge port, an ink jet head in which an electrothermal converting element such as a heat generating resistance body and an ink jet head in which an electromagnetic wave (such as electric wave or laser)/mechanical converting element or an electromagnetic wave/thermal converting element is used. Among them, in an ink jet recording apparatus of type in which the ink droplet is discharged by utilizing thermal energy, since nozzles can be arranged with high density, recording having high resolving power can be achieved.

Particularly, in an ink jet head using the electrothermal converting element as a thermal energy generating element, compactness can easily be achieved in comparison with the ink jet head using an electrical/mechanical converting element, and, further, high density arrangement can-easily be achieved with low cost by adequately utilizing merits of IC techniques and micro-working techniques, progress and reliability of which have been enhanced considerably in a recent semiconductor manufacturing field. A wiring substrate having base material of glass/epoxy for transmitting an electrical signal sent from a main body of the recording apparatus to a heater board provided in a converting portion of the converting element is adhered to the ink jet head. The heater board and the wiring substrate are interconnected by wire bonding. A contact pad contacted with and electrically connected to a flexible wiring substrate of the main body of the recording apparatus is provided on an upper surface of the wiring substrate.

In general ink jet heads, an ink amount required for the recording is stably supplied from an ink tank containing ink to nozzles. Further, in order to prevent leakage of ink through the discharge port, and more particularly, in order to maintain ink meniscus in the discharge port not to be broken, ink supplying pressure from the ink tank to the nozzles is adjusted to be negative pressure. As methods for adjusting the ink supplying pressure to be negative pressure, there are a method utilizing difference in water head from an ink introduction port of the ink tank directly containing the ink to the discharge port and method in which an ink absorbing body as a negative pressure generating member is disposed within the ink tank.

As methods for supplying the ink to the nozzles of the ink jet head, there are a method in which the ink is supplied to the nozzles by integrally or separately mounting the ink tank to the ink jet head on the carriage and a so-called tube supplying method in which the ink is supplied to the nozzles by connecting the ink jet head to the ink tank out of the carriage through a tube. In an ink jet printer consuming a large amount of ink, the ink tank must have a large capacity. In this case, if the ink tank having the large capacity is mounted on the carriage, since the ink jet printer itself becomes bulky, in such a printer, the tube supplying method is adopted.

In the ink jet head of tube supplying type, a buffer portion such as an ink reservoir, a filter or the like for storing the ink auxiliarily is provided between the ink tank and the head to prevent poor discharging and leakage of ink due to abrupt pressure change. Further, nozzles, ink storing space and ink introduction port which constitute an ink droplet discharging portion are also provided.

In such an ink jet head, if the nozzles are dried upon usage, when the ink is supplied into the nozzles, since ink wetting abilities of inner surfaces of the nozzles is changed, poor discharging may occur due to uneven wetting ability. To avoid this, when the head is transported, by filling the nozzles with ink not including color material (transparent ink not including color material), the head (interior of the nozzles) is maintained to a wetting condition. If the color material is included in the ink, when moisture which is main component of the ink is vaporized, the color material solved in the moisture is educed to clog the nozzles. The reason why the color material is not included in the ink not including the color material is that such clogging is prevented.

By the way, some ink jet heads of tube supplying type mounted on the carriage are designed so that air is housed in the ink storing portion containing the ink to be supplied to the nozzles. However, when the ink jet head of the type in which the air is housed in the ink storing portion is reserved, if inner pressure of the head is increased due to environmental change in a reserving step from the manufacture of the head to forwarding of the head or environmental change in a transporting step from the forwarding of the head to the transferring of the head to the user, the ink not including the color material may leak from the discharge ports of the nozzles or the ink introduction port.

Further, such leakage of the ink not including the color material may be further noticeable in dependence upon the posture of the head during the transportation.

In order to prevent the ink from leaking from the nozzles, it is considered that a tape or rubber sheet is directly adhered to the face surface to seal the nozzles. However, when the air is housed as mentioned above, pressure increase due to expansion of air becomes great, and, thus, in order to prevent the ink leakage, the tape or rubber sheet must be urged against the face surface with a considerably strong force. However, if the tape or rubber sheet is urged against the face surface with the strong force, the nozzles may be deformed. Further, foreign matters such as diry may be pinched between the tape or rubber sheet and the face surface to clog the nozzles, or adhesive of the tape may transfer to the face surface to change the ink wetting ability or damage the face surface.

SUMMARY OF THE INVENTION

In consideration of the above-mentioned problems, an object of the present invention is to provide a storing structure having high reliability, in which nozzles can be wetted positively and ink leakage and influence upon an electrical connection due to environmental change can be prevented and a face surface and the nozzles are not damaged.

To achieve the above object, according to a first aspect of the present invention, there is provided a storing structure for storing or reserving an ink jet head comprising a nozzle communicated with an opening for discharging liquid, a liquid storing portion for storing the liquid to be supplied to the nozzle, and a liquid introduction portion for introducing the liquid into the liquid storing portion from exterior, wherein, in the ink jet head, air is housed in the liquid storing portion and the liquid is contained at least in the nozzle, and a cap unit including an elastic cap for covering an area of the opening and a liquid absorbing member disposed in the elastic cap is closely contacted with and attached, around the opening, to a face in which the opening is formed, and the liquid introduction portion is communicated with atmosphere at least when inner pressure of the liquid storing portion is increased, thereby maintaining a space within the cap unit to a wetting condition.

Further, there is provided a storing structure for storing or reserving an ink jet head comprising a plurality of nozzles communicated with openings for discharging liquid, a plurality of liquid storing portions for storing the liquid to be supplied to the nozzles, and a plurality of liquid introduction portions for introducing the liquid into the liquid storing portions from exterior, wherein, in the ink jet head, air is housed in the liquid storing portions and the liquid is contained at least in the nozzles, and a cap unit including an elastic cap for covering an area of the openings and a liquid absorbing member disposed in the elastic cap is closely contacted with and attached, around the openings, to a face in which the openings are formed, and the liquid introduction portions are communicated with atmosphere at least when inner pressure of the liquid storing portions is increased, thereby maintaining a space within the cap unit to a wetting condition.

Further, the liquid introduction portion may comprise an elastic member in which a slit is formed.

Further, a communication pipe for communicating the interior of the ink jet head and the exterior of the ink jet head may be inserted into the liquid introduction portion.

Preferably, an insertion portion of the member to be inserted into the liquid introduction portion has a base end diameter greater than a tip end diameter.

Furthermore, preferably, the insertion portion is tapered to increase the diameter from the tip end to the base end.

The liquid contained in the nozzle may be ink not including color material.

The liquid contained in the nozzle may be ink.

The liquid is held by a capillary force of the nozzle.

A contact pad for electrically connecting the ink jet head to an ink jet printer may be provided on an outer surface of the ink jet head.

The liquid absorbing member in the cap unit attached to the ink jet head my not be contacted with the face in which the opening of the nozzle is formed.

The ink jet head in which the cap unit is attached to the face in which the opening of the nozzle is formed and an atmosphere releasing member is inserted into the liquid introduction portion and the liquid absorbing member is urged against an atmosphere release port of the atmosphere releasing member may be contained in a tray which may be in turn housed in a bag made of material low gas permeability.

The bag made of material low gas permeability may be aluminum bag.

In an ink jet head for effecting recording by discharging recording liquid from an opening of a nozzle, the cap unit detachable with respect to the face in which the opening of the nozzle is formed may comprise a protection member for protecting the face of the ink jet head in which the opening of the nozzle is formed, an elastic cap secured to the protection member and closely contacted with the face in which the opening of the nozzle is formed to cover a nozzle area, and a liquid absorbing member disposed within the elastic cap, and the elastic cap may be provided with an annular rib for closely contacting with outer periphery of the nozzle area to afford a closed space to the nozzle area.

Ink not including color material may be loaded in the liquid absorbing member, and the liquid absorbing member may not be contacted with the face in which the opening of the nozzle is formed in a condition that the cap unit is mounted to the ink jet head.

The protection member may be provided with a positioning portion capable of being positioned with respect to the ink jet head, and a clip-shaped engagement portion capable of being expanded and then hooked with respect to the ink jet head.

The present invention further provides a liquid filling method in a storage of an ink jet head comprising a nozzle communicated with an opening for discharging liquid, a liquid storing portion for storing the liquid to be supplied to the nozzle, and a liquid introduction portion for introducing the liquid into the liquid storing portion from exterior, comprising the steps of filling the liquid in the liquid storing portion, discharging the liquid within the liquid storing portion by sucking the liquid filled in the liquid storing portion from the opening for a predetermined time period, and attaching a cap unit to a face in which the opening is formed in a condition that the cap unit is closely contacted around the opening.

By adopting such a storing structure, in comparison with the conventional ink jet head in which the ink storing space is filled with the ink not including color material, since leakage of the ink not including color material caused by increase in inner pressure due to environmental change can be prevented and leakage of the ink not including color material caused in dependence upon the posture of the head can be prevented, an ink jet head having high reliability can be provided.

BRIEF DESCRIPTION OF THE DRAWINGS

FIG. 6A is a plan view showing a side of the cap unit contacted with a face surface, FIG. 6B is a sectional view taken along the line 6B—6B in FIG. 6A, and FIG. 6C is a side view looked at from a direction shown by the arrow 6C in FIG. 6A;

DETAILED DESCRIPTION OF THE PREFERRED EMBODIMENTS

The present invention will now be explained in connection with preferred embodiments thereof with reference to the accompanying drawings.

First of all, an example of an ink jet recording apparatus having an ink jet head to which a head storing structure of the present invention is applied will be described.

Figure 1:
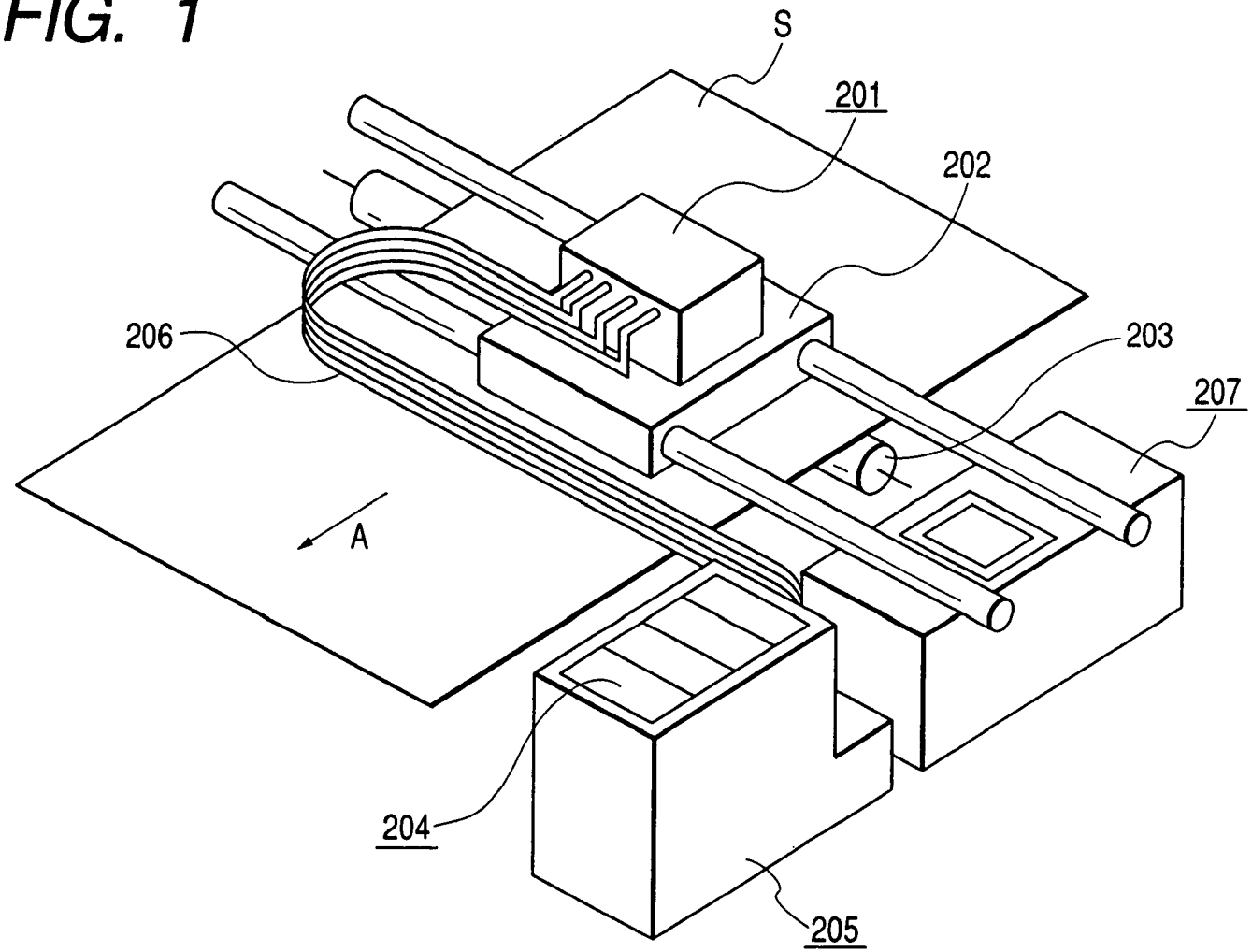
FIG. 1 is a perspective view showing a schematic construction of an ink jet recording apparatus according to an embodiment of the present invention.

FIG. 1 is a perspective view showing a schematic construction of an ink jet recording apparatus according to an embodiment of the present invention.

The ink jet recording apparatus shown in FIG. 1 is an ink jet printer of serial type in which, while a reciprocal movement (main scanning) of an ink jet head 201 and predetermined pitch conveyance (sub scanning) of a recording sheet S such as normal recording paper, special paper, OHP sheet or the like are repeated, an image (characters and/or symbols) is formed by selectively discharging ink from the ink jet head 201 in synchronous with such movement to adhere the ink onto the recording sheet.

In FIG. 1, the ink jet head 201 is detachably mounted on a carriage 202 slidably supported on two guide rails and reciprocally shifted along the guide rails by driving means such as a motor (not shown). The recording sheet S is conveyed by a conveying roller 203 in a direction (for example, direction shown by the arrow A) perpendicular to a shifting direction of the carriage 202 in such a manner that the recording sheet is opposed to an ink discharge face of the ink jet head 201 with a predetermined gap therebetween.

The ink jet head 201 has a plurality of nozzle arrays for discharging different color inks. In correspondence to the colors of inks discharged from the ink jet head 201, a plurality of discrete main tanks 204 are detachably mounted to an ink supply unit 205. The ink supply unit 205 is connected to the ink jet head 201 through a plurality of ink supplying tubes 206 corresponding to the ink colors so that, when the main tanks 204 are mounted to the ink supply unit 205, the respective color inks contained in the main tanks 204 can be supplied to the respective nozzle arrays independently.

Within a reciprocal shifting movement range of the ink jet head 201 and in a non-recording area out of a recording sheets passing area, a recovery unit 207 is disposed in a confronting relationship to the ink discharge face of the ink jet head 201.

Figure 2:
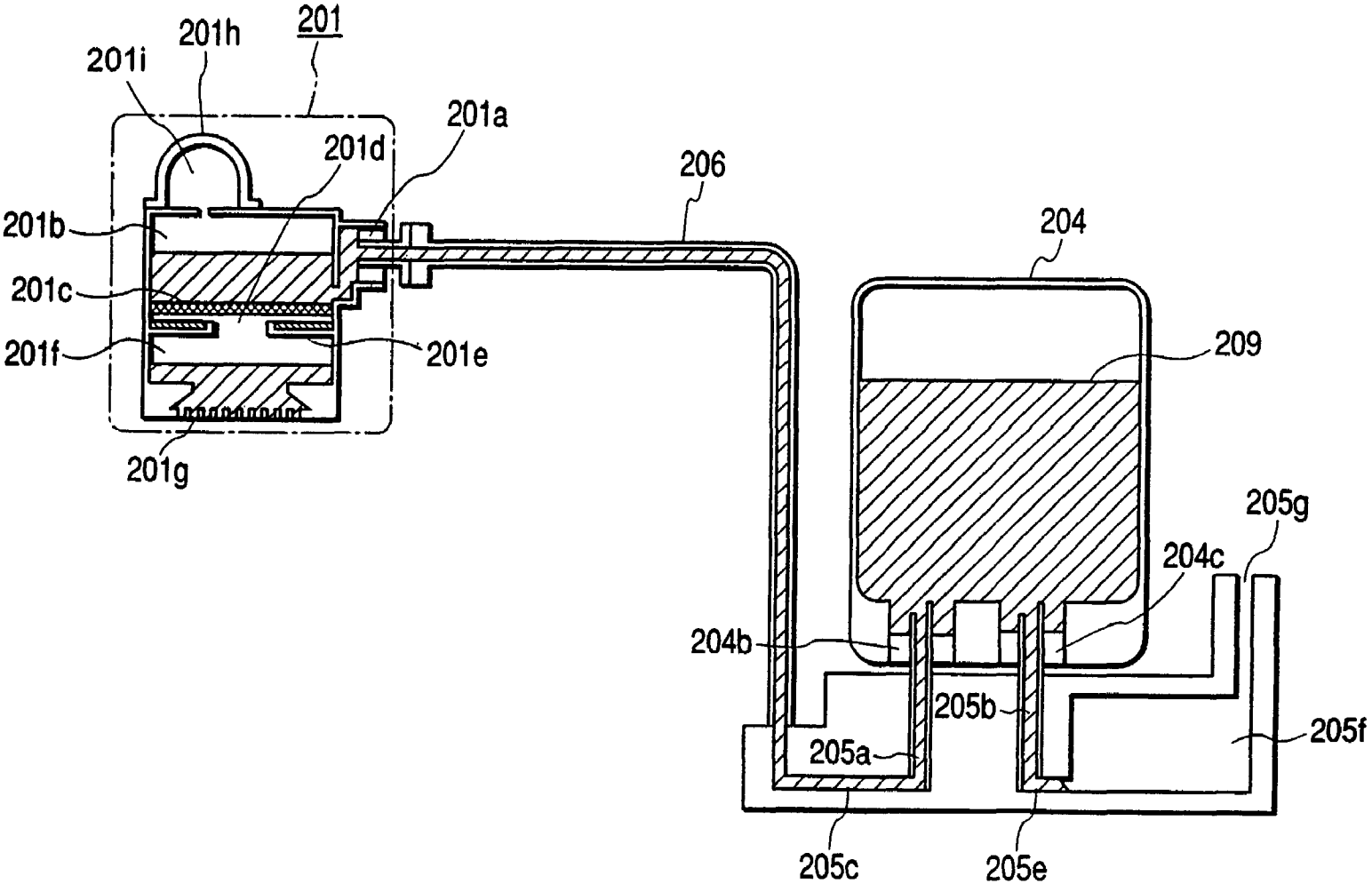
FIG. 2 is a view for explaining an ink supplying path of the ink jet recording apparatus of FIG. 1.

Next, a detailed construction of an ink supplying system of the ink jet recording apparatus will be explained with reference to FIG. 2. FIG. 2 is a view for explaining an ink supplying path of the ink jet head of FIG. 1. For simplifying the explanation, an ink supplying path for only one color is shown in FIG. 2.

First of all, the ink jet head 201 will be described.

The ink is supplied to the ink jet head 201 through a connector insertion port 201*a* to which a liquid connector provided on a tip end of the ink supplying tube 206 is sealingly connected. The connector insertion port 201*a* is communicated with a sub-tank portion 201*b* formed in an upper part of the ink jet head 201. Below the sub-tank portion 201*b* in a gravitational direction, there is provided a liquid chamber 201*f* for directly supplying the ink to a nozzle portion having a plurality of nozzles 201*g* arranged in parallel. The sub-tank portion 201*b* and the liquid chamber 201*f* are defined by a filter 201*c*, and a partition portion 201*e* having an opening 201*d* is disposed at a boundary between the sub-tank portion 201*b* and the liquid chamber 201*f*, and the filter 201*c* is rested on the partition portion 201*e*.

With this arrangement, the ink supplied to the ink jet head 201 through the connector insertion port 201*a* is supplied to the nozzles 201*g* through the sub-tank portion 201*b*, filter 201*c* and liquid chamber 201*f*. An area from the connector insertion portion 201*a* to the nozzles 201*g* is sealed with respect to atmosphere.

An opening is formed in an upper surface of the sub-tank portion 201*b* and the opening is covered by a dome-shaped elastic member 201*h*. A volume of a space (pressure adjusting chamber 201*i*) enclosed by the elastic member 201*h* is changed in accordance with pressure in the sub-tank portion 201*b* so that the pressure in the sub-tank portion 201*b* is adjusted, as will be described later.

Each nozzle 201*g* has a cylindrical shape having a sectional width of about 20 μm. The ink is discharged from the nozzle 201*g* by applying discharge energy to the ink in the nozzle 201*g*, and, after the discharging, new ink is introduced into the nozzle 201*g* by a capilliary force of the nozzle 201*g*. In order to apply the discharge energy to the ink in the nozzle 201*g*, the ink jet head 201 has energy generating means for respective nozzles 201*g*. In the illustrated embodiment, heat generating resistance bodies for heating the ink in the nozzles 201*g* are used as the energy generating elements, and, by selectively driving the heat generating resistance bodies on the basis of command from a head control portion (not shown) for controlling the driving of the ink jet head 201, film boiling is caused in the ink in the desired nozzle 201*g*, and the ink is discharged from the desired nozzle 201*g* by utilizing pressure of a bubble generated by the film boiling.

Although each nozzle 201*g* is disposed so that a tip end thereof for discharging the ink is faced downwardly, a valve mechanism for closing the tip end is not provided, so that the ink fills the nozzle 201*g* with meniscus formed therein. To this end, interior of the ink jet head 201 and particularly interior of the nozzle is maintained to a negative pressure condition. However, when the negative pressure is too small, if foreign matters and the ink are adhered to the tip end of the nozzle 201*g*, the meniscus of the ink may be broken to leak the ink from the nozzle 201*g*. On the other hand, when the negative pressure is too great, a force for pulling the ink back into the nozzle 201*g* becomes greater than the energy applied to the ink during the discharging, thereby causing poor discharging. Thus, the negative pressure in the nozzle 201*g* is maintained to a predetermined range slightly smaller than the atmospheric pressure. The range of the negative pressure is varied with the number of nozzles 201*g*, a cross-sectional area of the nozzle, performance of the heat generating resistance body and the like.

In the illustrated embodiment, since the ink jet head 201 is connected to the ink supply unit 205 via the ink supplying tube 206 and the position of the ink jet head 201 with respect to the ink supply unit 205 can be set relatively freely, the ink jet head 201 is positioned at a location higher than the ink supply unit 205 in order to generate the negative pressure in the ink jet head 201.

The filter 201*c* is constituted by metal mesh having fine pores of 10 μm or less smaller than the sectional width of the nozzle 201*g* in order to prevent foreign matters which may clog the nozzles 201*g* from flowing from the sub-tank portion 201*b* to the liquid chamber 201*f*. The filter 201*c* has a feature that, when the ink is contacted with only one surface of the filter 201*c*, ink menisci are formed in the fine pores by a capilliary force to permit passage of ink but to make air flow difficult. The smaller the size of fine pore the stronger strength the meniscus to make the air flow further difficult.

In the filter 201*c* used in the illustrated embodiment, pressure required for permitting the air flow is about 0.1 atm (10.1325 kPa). Thus, if air exists in the liquid chamber 201*f* disposed at a downstream side of the filter 201*c* in the ink moving direction within the ink jet head 201, since the air cannot pass through the filter 201*c* by buoyancy of the air itself, the air in the liquid chamber 201*f* remains in the liquid chamber 201*f*. In the illustrated embodiment, this phenomenon is utilized. Namely, the liquid chamber 201*f* is not fully filled with air, but a layer of air is provided between the ink in the liquid chamber 201*f* and the filter 201*c*. That is, a predetermined amount of ink is stored in the liquid chamber 201*f* so that the ink in the liquid chamber 201*f* is spaced apart from the filter 201*c* by such an air layer. In the illustrated embodiment, by adopting a large liquid chamber in this way, there is provided a structure in which bubbles are easily trapped below the filter, so that the bubbles are hard to reach the nozzles and bubbles generated by the discharging are also apt to be shifted below the filter. With this arrangement, a head structure which is hard to be influenced by the bubbles as a main factor for causing unstable printing is provided.

Further, the ink in the partition portion below the filter is contacted with the filter so that, if the ink below the filter is expanded due to change in environmental temperature, such ink is shifted above the filter, thereby absorbing pressure. However, if an amount of the air below the filter is increased above a predetermined value, since the temperature change cannot be absorbed, suction is effected periodically to maintain the air amount below the filter to a given range.

The amount of the ink stored in the liquid chamber 201*f* is at least an amount required for filling the nozzles 201*g* with the ink. If the air from the liquid chamber 201*f* enters into the nozzle 201*g*, since the ink is not replenished into the nozzle 201*g* after the ink discharging thereby cause poor discharging, the nozzles 201*g* must always be filled with the ink.

The upper surface of the filter 201*c* is contacted with the ink in the sub-tank portion 201*b*, and an area contacted with the ink is an effective area of the filter 201*c*. Pressure loss across the filter 201*c* depends upon the effective area of the filter 201*c*. In the illustrated embodiment, the filter 201*c* is installed horizontally in a use condition of the ink jet head 201 so that the effective area of the filter is maximized by contacting the ink with the entire upper surface of the filter 201*c*, thereby reducing the pressure loss.

The pressure adjusting chamber 201*i* is a chamber a volume of which is reduced as inner negative pressure is increased, and, as is in the illustrated embodiment, when the pressure adjusting chamber 201*i* is constituted by the elastic member 201*h*, the elastic member 201*h* is preferably made of rubber material. Further, the chamber may be constituted by a combination of a plastic sheet and a spring, other than the elastic member 201*h*. By providing such a pressure adjusting chamber 201*i*, the ink discharging can be stabilized, and influence of pressure loss in the ink supply path from the main tanks 204 to the ink jet head 201 can be suppressed. Thus, diameters of the ink supplying tubes 206 moved together with the carriage 202 can be reduced, thereby reducing shifting burden of the carriage 202.

Next, the ink supply unit 205 and the main tanks 204 will be explained.

The main tanks 204 are detachable with respect to the ink supply unit 205, and each main tank is provided at its bottom with an ink supply port sealed by a rubber cock 204*b*, and an atmosphere introduction port sealed by a rubber cock 204*c*. Each main tank 204 is a single sealed container, and ink 209 is contained in the main tank 204 as it is.

On the other hand, the ink supply unit 205 has an ink supply needle 205*a* for picking up the ink 209 from each main tank 204, and an atmosphere introduction needle 205*b* for introducing the atmosphere into each main tank 204. The ink supply needle 205*a* and the atmosphere introduction needle 205*b* are both constituted by hollow needles and are disposed in a confronting relationship to the ink supply port and the atmosphere introduction port of the corresponding main tank 204 with needle tips thereof facing upwardly. When the main tank 204 is mounted to the ink supply unit 205, the ink supply needle 205*a* and the atmosphere introduction needle 205*b* penetrate into and pass through the rubber cocks 204*b*, 204*c*, respectively, thereby entering into the interior of the main tank 204.

The ink supply needle 205*a* is connected to the corresponding ink supplying tube 206 through a liquid path 205*c*. The atmosphere introduction needle 205*b* is communicated with the atmosphere through a liquid path 205*e*, a buffer chamber 205*f* and an atmosphere communication port 205*g*. A height of the liquid path 205*c* located at a lowest position in the ink supply path from the ink supply needle 205*a* to the ink supplying tube 206 is the same as a height of the liquid path 205*e* located at a lowest position in the ink supply path from the atmosphere introduction needle 205*b* to the atmosphere communication port 205*g*.

With the arrangement as mentioned above, when the ink in the ink jet head 210 is consumed, due to the negative pressure, the ink is supplied from the main tanks 204 to the ink jet head 201 through the ink supply unit 205 and the ink supplying tubes 206 at any time. In this case, the air having the same amount as the ink supplied from the main tanks 204 is introduced into the main tanks 204 from the atmosphere communication ports 205*g* through the buffer chambers 205*f* and the atmosphere introduction needles 205*b*.

Figure 3:
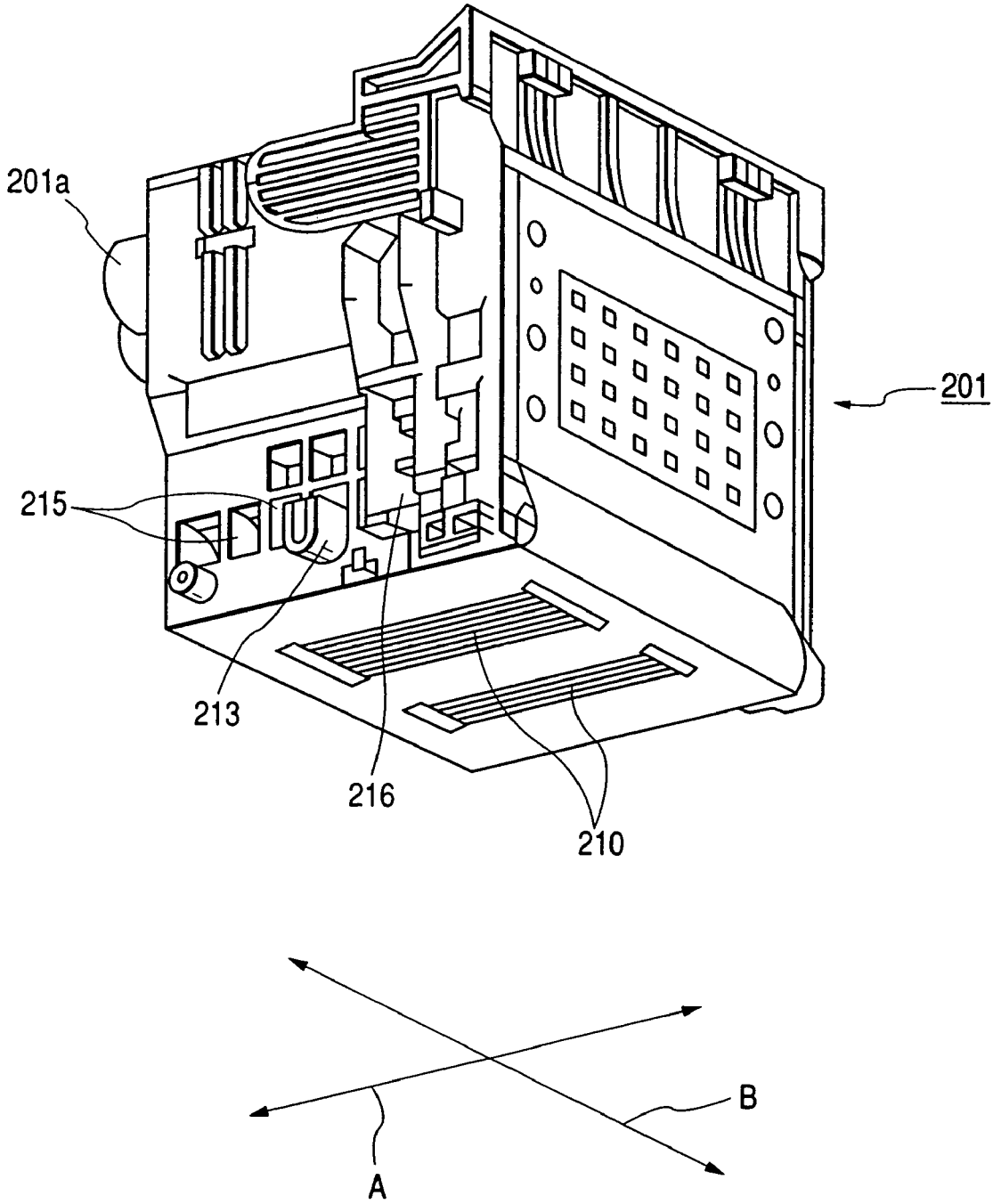
FIG. 3 is a lower perspective view of the ink jet head of FIG. 2.
Figure 4:
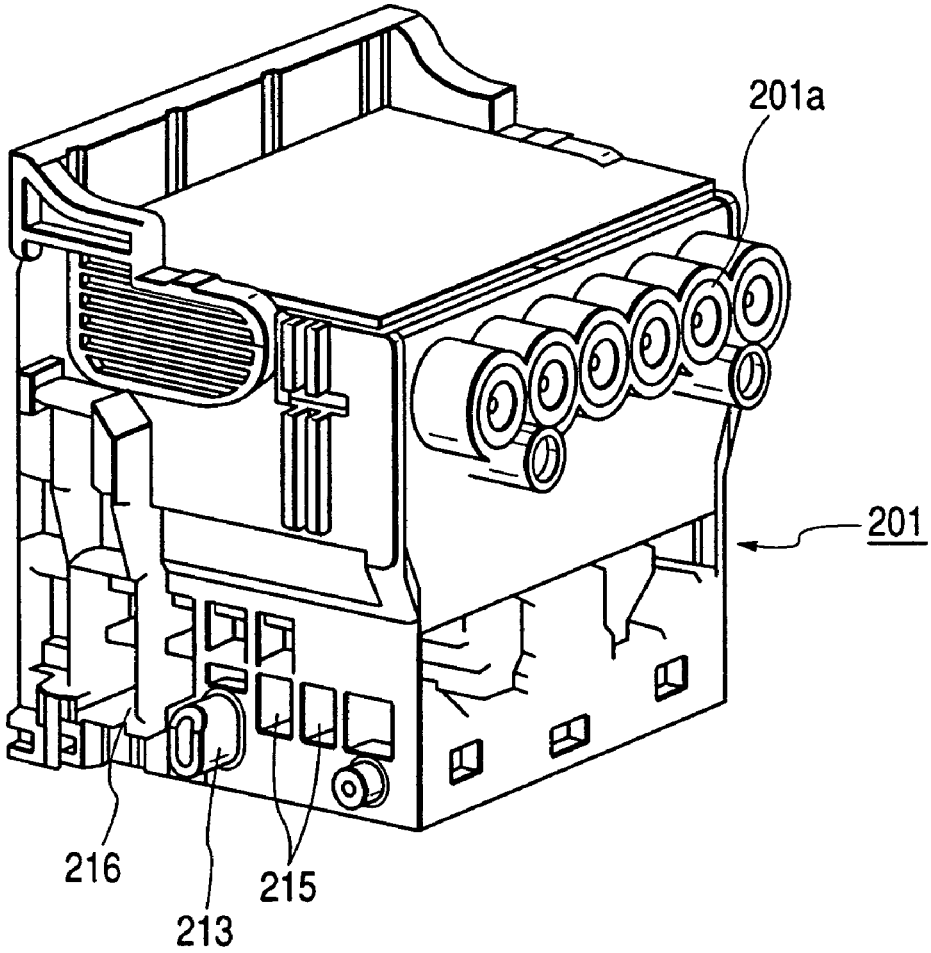
FIG. 4 is an upper perspective view of the ink jet head of FIG. 2.

Further, an outer appearance of the ink jet head 201 used in the above-mentioned ink supplying system is, for example, as shown in FIGS. 3 and 4. FIG. 3 is a lower perspective view of the ink jet head 201, and FIG. 4 is an upper perspective view of the ink jet head 201. FIGS. 3 and 4 show plural ink jet heads 201, and discharge ports 210 shown in FIG. 3 are openings of the nozzles 201*g*, and a plurality of arrays each constituted by plural discharge ports extend in the shifting direction of the carriage in parallel with each other.

Structure for Storing Head

Next, an ink jet head storing structure according to the present invention will be explained. Here, while an example that the above-mentioned ink jet head 201 is stored or reserved will be explained, the present invention is not limited to such an example but, the storing structure of the present invention can be applied to any head of ink jet type having a nozzle in which a discharge energy generating element is disposed and an ink storing portion connected to the nozzle.

First Embodiment

Figure 5A:
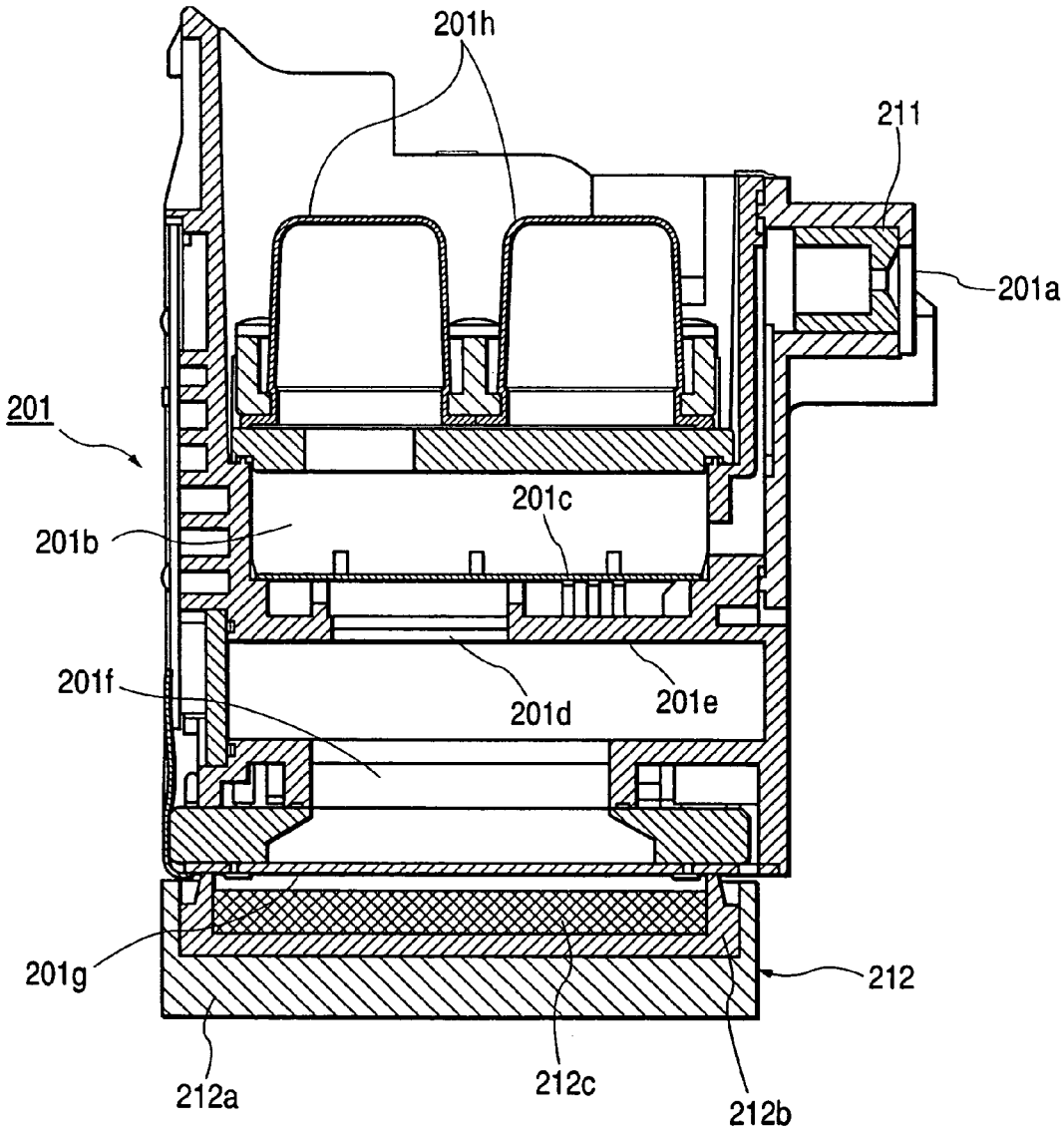
FIG. 5A is a longitudinal sectional view of a head, showing a storing structure for an ink jet head according to a first embodiment of the present invention.
Figure 5B:
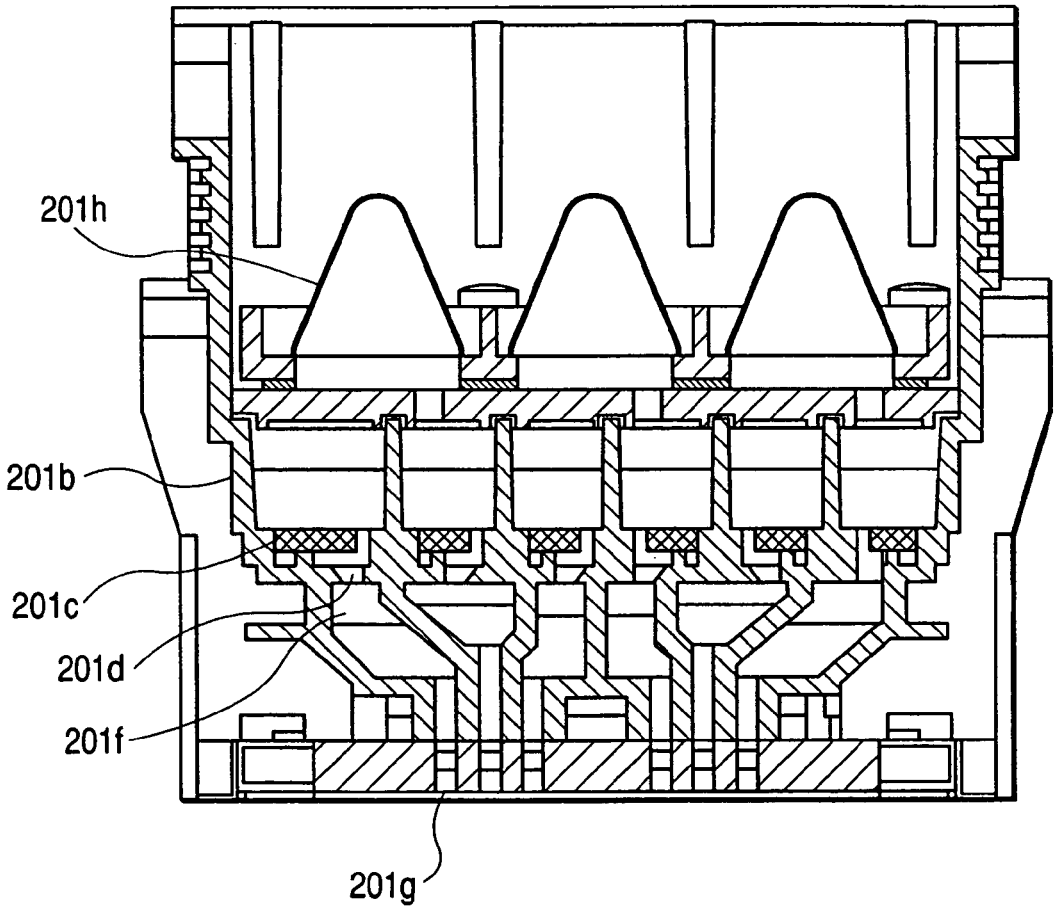
FIG. 5B is a longitudinal sectional view showing the ink jet head according to the first embodiment of the present invention.

FIG. 5A is a longitudinal sectional view of a head, showing a storing structure for an ink jet head 201 according to a first embodiment of the present invention, and FIG. 5B is a sectional view looked at from a vertical direction with respect to FIG. 5A.

The recording head 201 according to this embodiment is designed to discharge the ink from six nozzle arrays, and the inks are supplied to the arrays of nozzles 201*g* independently from the respective main tanks 204 shown in FIG. 1 through the respective ink supplying tubes 206, sub-tanks 201*b* and liquid chambers 201*f*.

Figure 9:
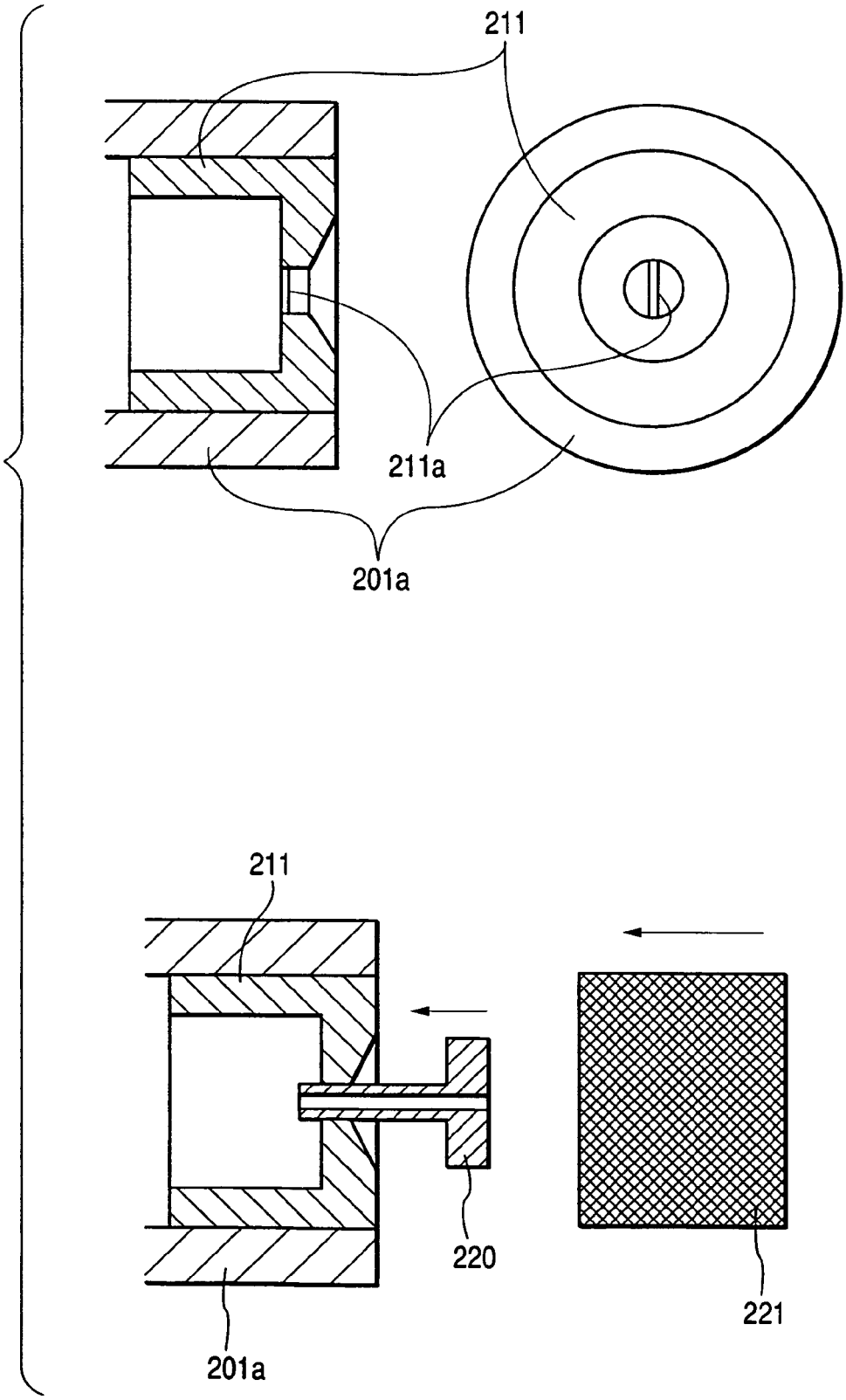
FIG. 9 is a view for explaining a slit of joint rubber, release cap and absorbing body in FIG. 8.

In FIGS. 5A and 5B, joint rubber 211 is fitted, by press-fit, into the connector insertion port 201*a* connected to the sub-tank portion 201*b* of the ink jet head 201. The ink joint rubber 211 has a slit 211*a* (refer to FIG. 9B) into which a joint needle (needle-shaped tube) of a liquid connector provided at a tip end of the ink supplying tube 206 is inserted. Namely, the ink introduction portion to the interior of the ink jet head is formed as the slit of the elastic member. The reason is that, when forwarding checking (inspection) of the head 201 is effected, the head 201 must be handled in a condition that the ink is included in the head 201. In this case, if the connector insertion port 201*a* is opened to the atmosphere, since the head 201 itself does not have the negative pressure generating mechanism, the ink may be leaked from the nozzles. To avoid this, in the illustrated embodiment, there is provided the slit 211*a* for sealing the connector insertion port 201*a* in a normal condition. The joint needle insertion slit seals the connector insertion port 201*a*, except that the joint needle is inserted into the slit. When the head is transported, a cap unit 212 is attached to a face surface (face forming the discharge ports 210 shown in FIG. 3) into which the discharge ports of the nozzles 201*g* of the ink jet head 201 are opened.

Figure 6C:
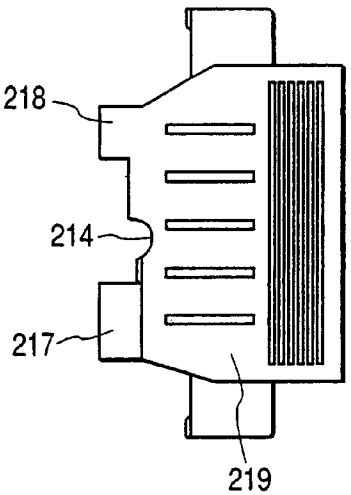
FIGS. 6A, 6B and 6C are views for explaining a cap unit, where
Figure 6A:
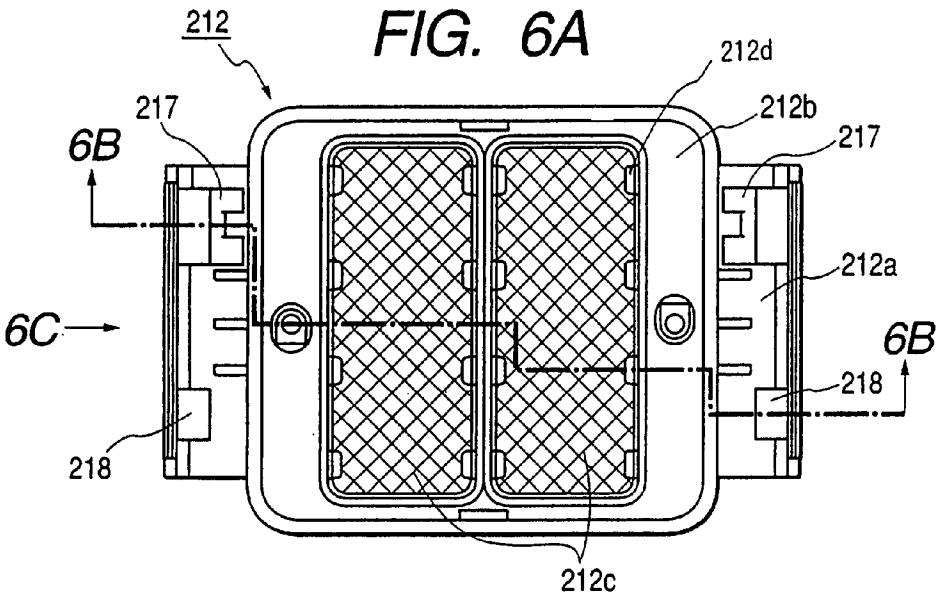
Figure 6B:
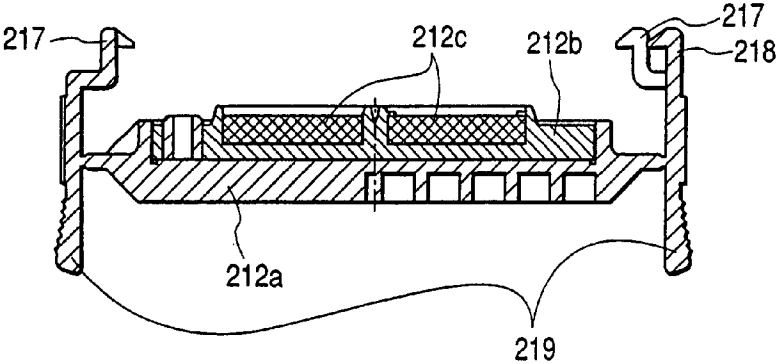

FIGS. 6A to 6C are views for explaining the cap unit 212 for the face surface, where FIG. 6A is a plan view showing a side of the cap unit contacted with the face surface, FIG. 6B is a sectional view taken along the line 6B—6B in FIG. 6A, and FIG. 6C is a side view looked at from a direction shown by the arrow 6C in FIG. 6A.

Figure 7:
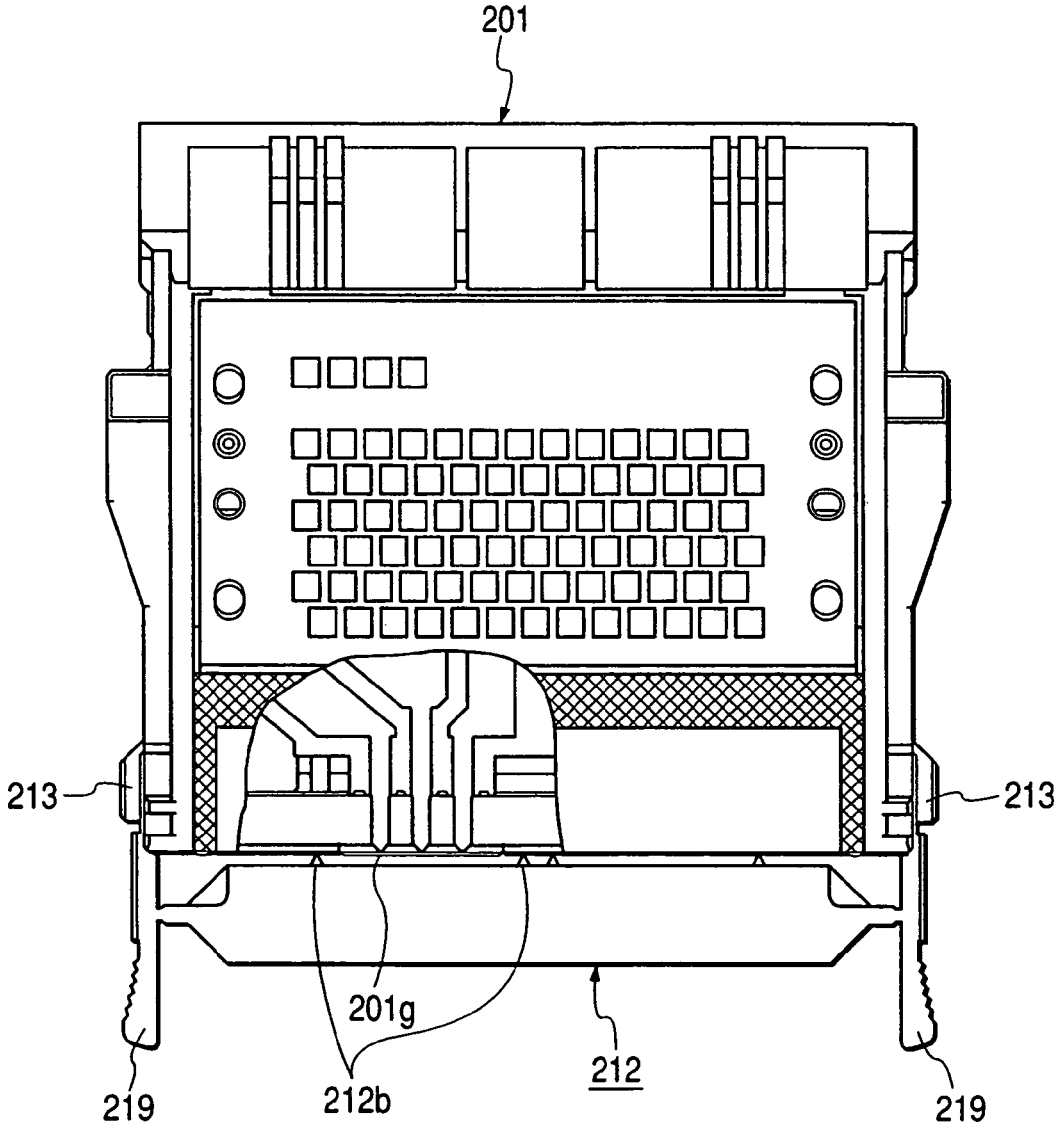
FIG. 7 is a partial sectional side view of an ink jet head on which the cap unit of FIGS. 6A to 6C is mounted.

As shown in FIG. 7, the cap unit 212 comprises a protection cap 212*a* as a protection member for acting as an outer frame of the unit and for protecting the face surface, cap rubbers (elastic caps) 212*b* secured in recesses of the protection cap 212*a*, and water absorbing resins (liquid absorbing members) 212*c* secured in recesses of the cap rubbers 212*b*.

Each rubber cap 212*b* is provided with an annular rib for closely contacting with the face surface of the ink jet head 201 around an area in which the plural discharge port arrays are formed. Thus, upper surfaces of the absorbing resins 212*c* are located below uppermost surfaces of the cap rubbers 212*b*. As a result, when the capping is effected, as shown in FIGS. 5A, 5B and FIG. 7, the cap rubbers 212*b* create closed spaces without contacting with the discharge ports of the nozzles 201*g*. With this arrangement, humidity in the nozzles 201*g* can be ensured without damaging the nozzles 201*g*.

The protection cap 212*a* is provided with a positioning guide 214 for a positioning boss (213 in FIGS. 3 and 4) provided on the ink jet head 201 side, and a clip portion 219 having pawl portions 217, 218 capable of once expanding and then fitting onto hook portions (215, 216 in FIGS. 3 and 4) provided on the ink jet head 201 side.

The cap unit 212 having the above-mentioned construction is positioned by the boss 213 as the positioning member provided on the ink jet head 201 and is detachably mounted to the ink jet head 201 by hooking the pawl portions 217, 218 of the clip portion 219 on the hook portions 215, 216 provided on the ink jet head 201 (FIG. 7).

Next, an ink filling amount in a transporting condition will be explained. In the head according to the illustrated embodiment, as shown in FIG. 2, the bubbles are retained below the filter also in the normal use condition. Thus, as mentioned above, although it is designed so that the ink in the partition portion below the filter is shifted above the filter to absorb the expansion of the bubbles caused by temperature change when the head is being used, when the head is transported, since the temperature change and days of leaving the head are great in comparison with the mounting condition of the head, it is very difficult to completely absorb expansion of the bubbles below the filter. Further, it is required to prevent the ink above the filter from leaking.

Thus, in the present invention, when the head is transported, the ink filling amount is selected to a minimum ink amount capable of keeping the head to a saturated condition, i.e., an amount that only the nozzles are filled with the ink. Even if the ink is leaked from the nozzles, the leaked ink is absorbed by the absorbing resin in the closed cap. Concretely, the structure is as shown in FIGS. 5A, 5B and 7.

As shown in FIGS. 5A, 5B and 7, in the storing structure in which the cap unit 212 is mounted, ink not including color material is loaded at least in the nozzles 201*g* of the head 201, and such ink not including color material does not exist in the spaces above and below the filter. In this case, it is desirable that an amount of the ink not including color material loaded in the nozzles is slightly greater than a saturated water vapor amount regarding the volume of "head+cap". Each absorbing resin 212*c* has a capacity or ability capable of well absorbing the amount of ink not including color material loaded in the nozzles. In the illustrated embodiment, the ink amount is 1 to 2 grams in total, and, in the loading method, after the forwarding check printing is effected by using the normal ink, the ink not including color material is introduced through the connector insertion ports 201*a* to replace the normal ink by the ink not including color material within the head, and then, the ink not including color material in the head is sucked for a predetermined time to discharge the ink not including color material. In the construction having the large liquid chamber according to the illustrated embodiment, even when the ink is sucked for the predetermined time, since the ink still remains in corners of the liquid chamber and the like, in a little while, the ink enters into the nozzles, with the result that the ink not including color material can be loaded in the nozzles.

Now, an operation when the inner pressure of the head is increased in this condition will be explained.

The sub-tank portion 201*b* above the filter is communicated with the slit 211*a* of the joint rubber 211. Although the slit 211*a* is normally closed, when the inner pressure of the head is increased, the slit is opened to release the pressure. When the filter is not impregnated by the ink, since the liquid chamber 201*f* is communicated with the sub-tank portion 201*b*, the pressure is released similarly. However, since the filter is apt to be wetted by the ink, it is considered that the filter becomes the ink impregnated condition. In this case, the ink not including color material in the nozzles may be dropped from the face surface due to the increase in the inner pressure.

In the illustrated embodiment, even if the ink not including color material in the nozzles is dropped from the face surface due to the increase in the inner pressure, since such ink is absorbed by the absorbing resin 212*c*, the ink is not leaked out of the head. Namely, since the nozzles and therearound are closely sealed to prevent ink leakage, a condition that the nozzles are positively filled with the ink or saturated water vapor is maintained. Further, since the ink is not leaked out of the cap, a bad influence is not affected upon the electrical connections. In addition, since the cap is not contacted with the nozzles, the nozzles are not damaged.

In this way, even in the structure in which the air exists within the ink jet head, an ink jet head having high reliability that the ink can be prevented from leaking outwardly even during the transportation can be provided.

Particularly, in the head in which the air is apt to be remained below the filter, since it is difficult to fill the space between the filter and the nozzles with the ink not including color material, the transporting style according to the illustrated embodiment is advantageous.

In the head in which the face surface is closely sealed in this way, normally, there is a predetermined gap between the head face surface and the absorbing resins 212*c* of the cap, because of tolerance in fitting portions in a positional relationship between the head 201 and the cap 212*a*. Upon designing the cap, in consideration of such tolerance, a squeezing amount of the tip end ribs of the cap rubbers 212*b* and the gap between the face surface and the absorbing resins 212*c* are determined. It is normal that the absorbing resins are not contacted with the face surface. The reason is that the face surface has normally water repellency, and if the absorbing resins are contacted with the face surface, the face surface is always immersed in the ink not including color material, with the result that the water repellency may be deteriorated. Further, in addition to danger of influence of elution from the absorbing resins 212*c* and adhesion of dirt to the face surface, there is a danger of damaging the face surface. Further, the cap rubbers 212*b* are provided with projections (212*d* in FIG. 6) for securing the respective absorbing resins 212*c*, and the projections 212*d* must be spaced apart from the tip end ribs of the cap by a predetermined distance so that the sealing ability is not worsened by the influence of squeezing of the tip end ribs of the cap.

Further, it is considered that a force for urging the cap 212 against the face surface is generated if the head is dropped or when the cap 212 is mounted. Even in such cases, it is required that the tip end ribs of the cap rubbers be prevented to be further squeezed to contact the absorbing resins 212*c* of the cap with the face surface.

For these reasons, it is desirable that the predetermined gap is always maintained between the head face surface and the absorbing resins 212*c* of the cap.

Now, a feature for always maintaining such a gap according to the illustrated embodiment will be explained.

Figure 11A:
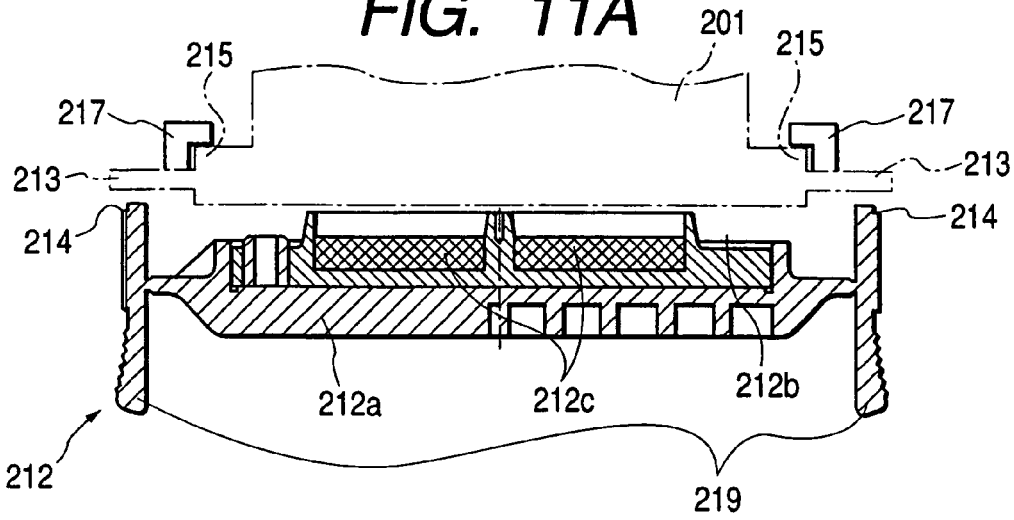
FIGS. 11A, 11B and 11C are views showing conditions that a cap unit is mounted on the ink jet head of the present invention.
Figure 11B:
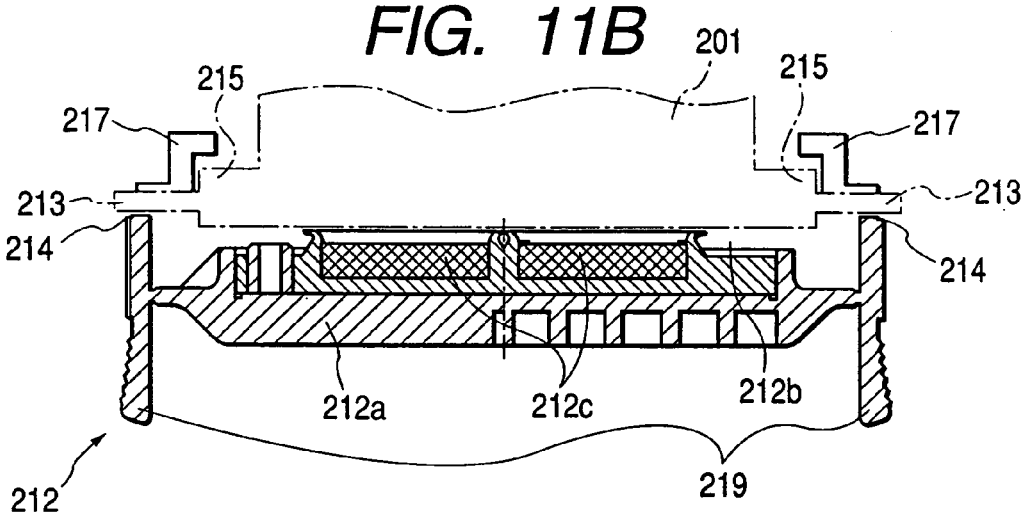
Figure 11C:
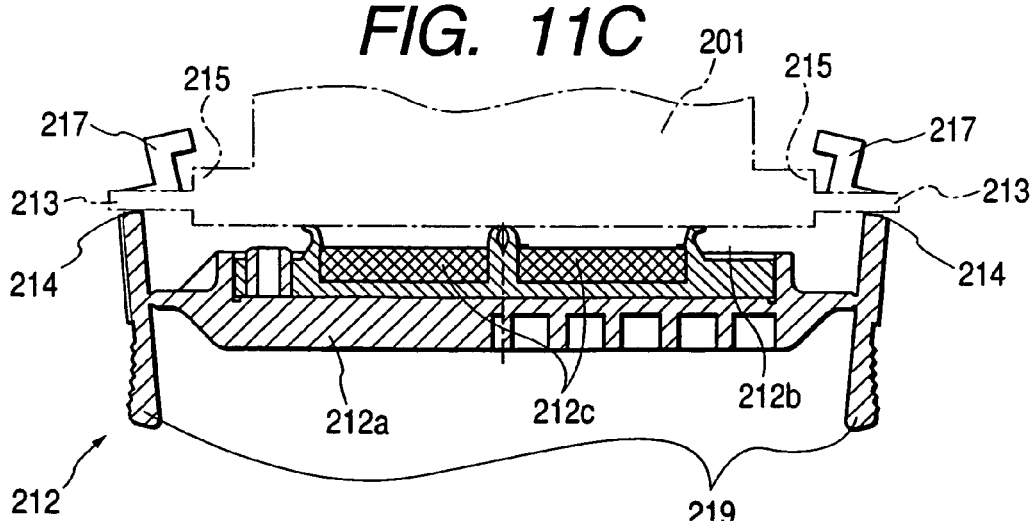

FIGS. 11A to 11C are views schematically showing engagement between the cap unit 212 and the ink jet head 201 in the illustrated embodiment. In FIGS. 11A to 11C, a section of an engagement portion between the pawl portion 217 of the cap 212 and the hook portion 215 of the head 201 and a section of an engagement portion between the positioning guide 214 of the cap 212 and the positioning boss 213 of the head 201 are shown simultaneously in order to facilitate the understanding of the positional relationship between the cap 212 and the head 201.

FIG. 11A is a view showing a condition that the cap 212 is mounted normally and thus a condition that the pawl portion 217 of the cap 212 is contacted with and engaged by the hook portion 215 of the head 201. In the condition that the cap 212 is mounted, since a repelling force caused due to the squeezing of the tip end ribs of the cap rubbers is generated, normally, the pawl portion 217 of the cap 212 is contacted with and engaged by the hook portion 215 of the head 201. In this case, as shown, the positioning guide 214 of the cap 212 is spaced apart from the positioning boss 213 of the head 201 with a slight gap therebetween.

FIG. 11B is a view showing a condition that a force for urging the cap 212 against the face surface is applied. In this condition, the positioning guide 214 of the cap 212 is contacted with and engaged by the positioning boss 213 of the head 201. Thus, even when the force for urging the cap 212 against the face surface is applied, the absorbing resins 212*c* of the cap are prevented from being contacted with the head face surface. Namely, when the force for urging the cap against the face surface is applied, as shown, although the pawl portion 217 of the cap 212 is disengaged from the hook portion 215 of the head 201 to further squeeze the tip end ribs of the cap rubbers, the positioning guide 214 of the cap 212 is contacted with the positioning boss 213 of the head 201 before the absorbing resins 212*c* of the cap are contacted with the head face surface.

FIG. 11C is a view showing a condition that the cap 212 is mounted and dismounted with respect to the head 201, and, as mentioned above, this condition is a condition that the cap is temporarily widened. As explained in connection with FIG. 11B, the cap 212 can be mounted and dismounted with respect to the head 201 without contacting the absorbing resins 212*c* of the cap with the head face surface. In this case, as shown, the engagement portion of the positioning guide 214 is selected to be longer than the engagement portion of the pawl portion 217 in a cap widening direction so that the positioning guide 214 of the cap 212 is contacted with the positioning boss 213 of the head 201 even when the cap 212 is widened to disengage the pawl portion 217 of the cap 212 from the hook portion 215 of the head 201.

As mentioned above, in the illustrated embodiment, since the positioning guide of the cap also acts to protect the head face surface, even if the force for urging the cap 212 against the face surface is generated if the head is dropped or when the cap 212 is mounted, the absorbing resins 212*c* of the cap are not contacted with the head face surface. Thus, the predetermined gap can always be maintained between the head face surface and the absorbing resins 212*c* of the cap, thereby providing a cap having high reliability in which the face surface is not damaged.

In place of the positioning guide 214 according to the illustrated embodiment, although it is considered that projections are provided on the cap at positions where the projections abut against the head face surface, since shock acts on the face surface, such projections are not preferable. Particularly, as is in the illustrated embodiment, in the cap of type in which the engagement is established by widening the cap, since there is a danger of rubbing the face surface by the projections, such projections are not more preferable.

By the way, since the face surface is capped, although the ink is not leaked out of the head, there is a danger of flowing the ink not including color material out of the nozzles due to shock upon dropping. Now, an embodiment for preventing ink dropping from the face surface is shown in FIGS. 12A and 12B.

Figure 12A:
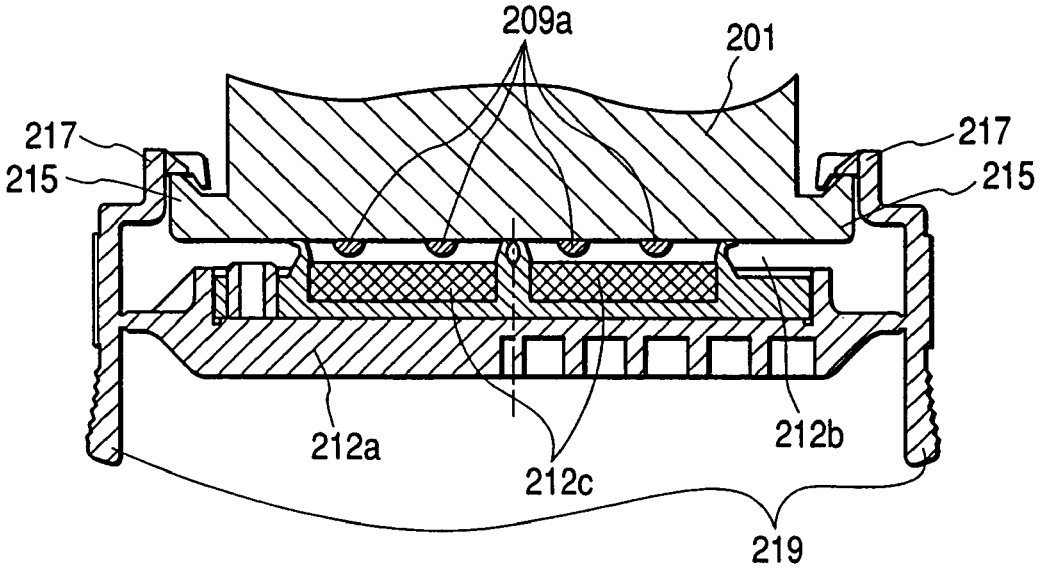
FIGS. 12A and 12B are views showing positional relationship between a face in which openings are formed and the cap unit when ink is leaked from the openings of the ink jet head.

FIG. 12A shows a condition that the ink not including color material exuded to form ink droplets 209*a* on the face surface. Each ink droplet 209*a* has possibility that it grows up to a size corresponding to the gap between the face surface and the absorbing resin 212*c* at the maximum.

In this condition, when the cap is dismounted, the ink droplets 209*a* remain on the face surface. In such a condition, when the head is handled, the ink droplet 209*a* may be combined to form larger ink droplets which are in turn dropped from the face surface.

Figure 12B:
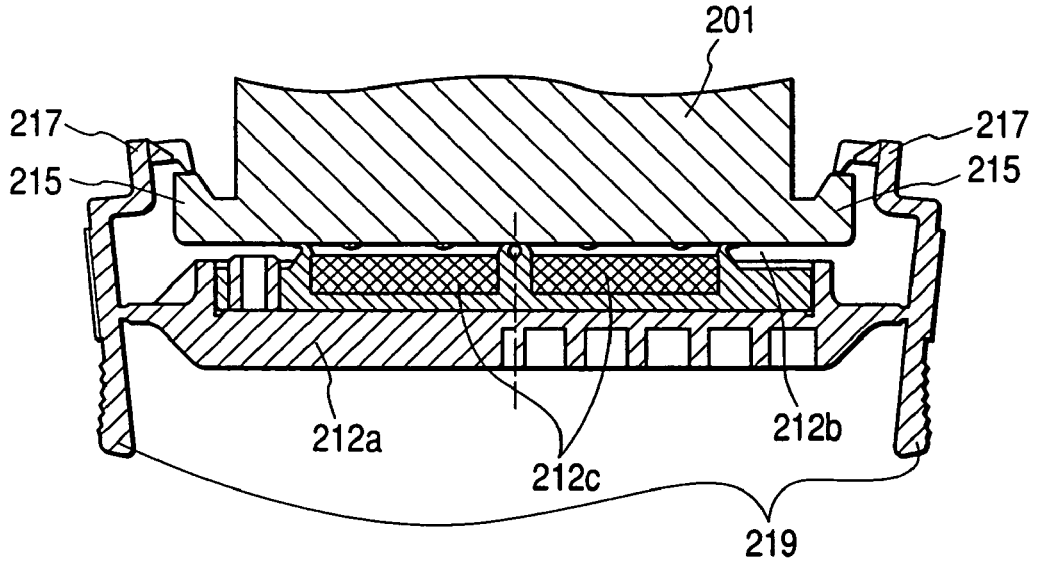

However, in the illustrated embodiment, regarding the face surface and the absorbing resins 212*c* of the cap, when the cap is dismounted, as shown in FIG. 12B, since the tip end ribs of the cap rubbers 212*b* are squeezed so that the large ink droplets 209*a* are absorbed by the absorbing resins 212*c*, the large ink droplets are removed from the face surface.

As a result, since there is no large ink droplet after the cap is dismounted, when the head is handled, any ink droplet does not drop from the face surface.

Thus, in comparison with the conventional ink jet head in which the ink storing space is filled with the ink not including color material, even when the inner pressure of the head is increased, the ink not including color material is not leaked, and leakage of the ink not including color material due to the difference in posture of the head can also be prevented. Namely, an ink jet head in which high reliability is maintained even when the environment is changed during the storage can be provided. Further, a cap having high reliability can be obtained by combining with the construction in which the positioning guide of the cap also acts to protect the face surface as shown in FIGS. 11A to 11C.

Figure 8:
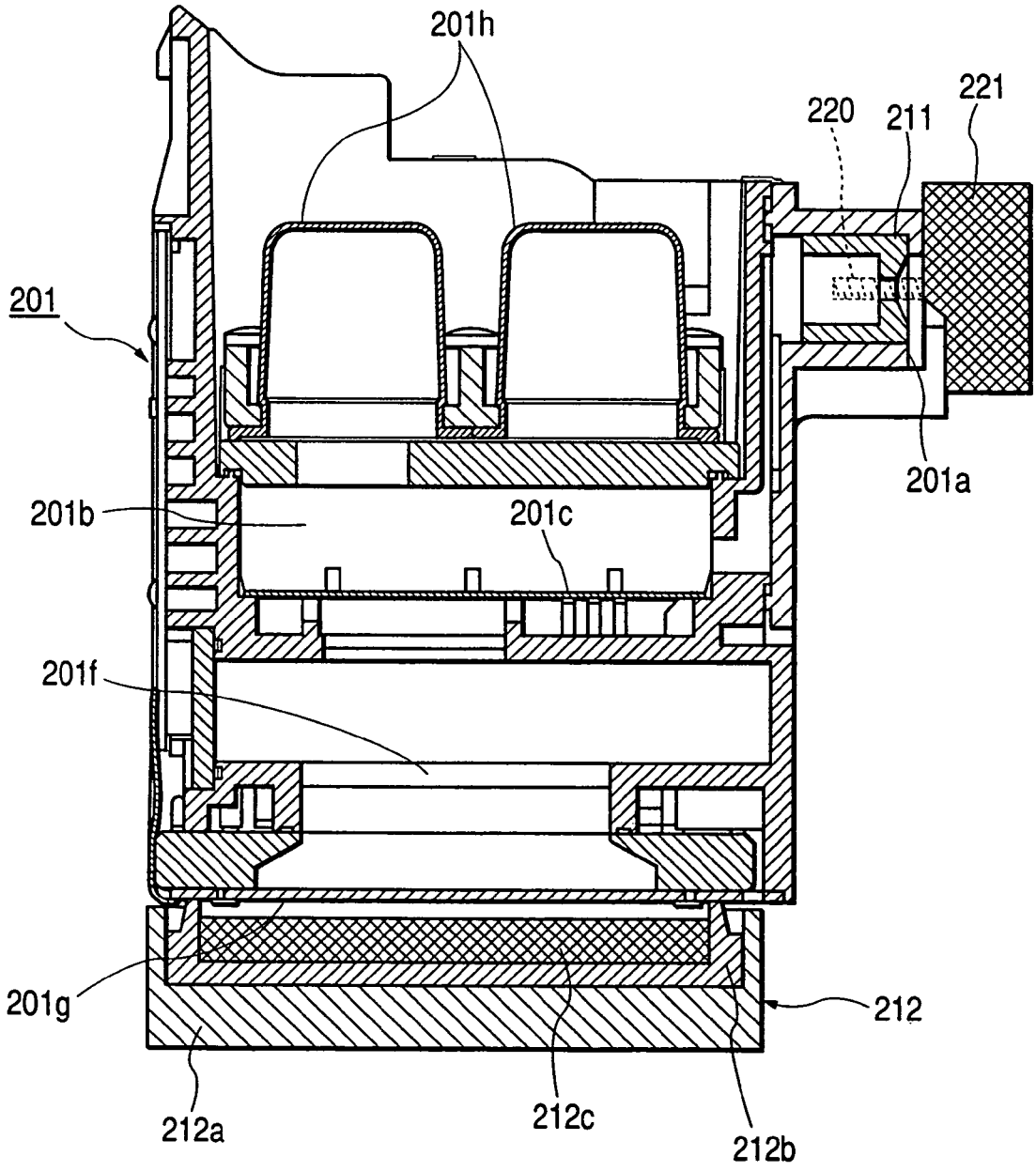
FIG. 8 is a longitudinal sectional view of a head, showing a storing structure for an ink jet head of the present invention when a release cap is inserted.

FIG. 8 is a longitudinal sectional view of the head, showing a condition that a release cap 220 is inserted into a joint rubber 211 through slit 211*a* thereof (see FIG. 9), such that a cylindrical pipe portion of release cap 220 functions as a slit-forming member.

As shown in FIG. 8, a release cap (atmosphere releasing member) 220 for releasing the closed space in the ink jet head 201 to the atmosphere is inserted into the joint rubber 211 in the connector insertion port 201*a* as the ink introduction portion to the ink jet head 201, and an absorbing body 221 is urged to be closely contacted with an atmosphere releasing port of the release cap 220. As a result, if the liquid in the sub-tank is discharged through the atmosphere releasing port for any reason, such liquid can be absorbed by closely contacting the absorbing body 221 with the atmosphere releasing port, thereby preventing an area surrounding the head from being wetted. The release cap 220 has a thumbtack-like shape having a cylindrical pope with a flange, so that the closed space of the ink jet head 201 can be released to the atmosphere by inserting the cylindrical pipe into the closed slit 211*a* (see FIG. 9) of the joint rubber 211.

Further, even if the closed space cannot be released to the atmosphere in dependence upon the posture of the head, the ink not including color material leaked by the inner pressure of the head is absorbed by the liquid absorbing member and held therein, and, since the cap unit is closely contacted around the discharge ports, the ink is not leaked from the head, thereby keeping the condition that the ink not including color material exists in the nozzles.

Figure 13:
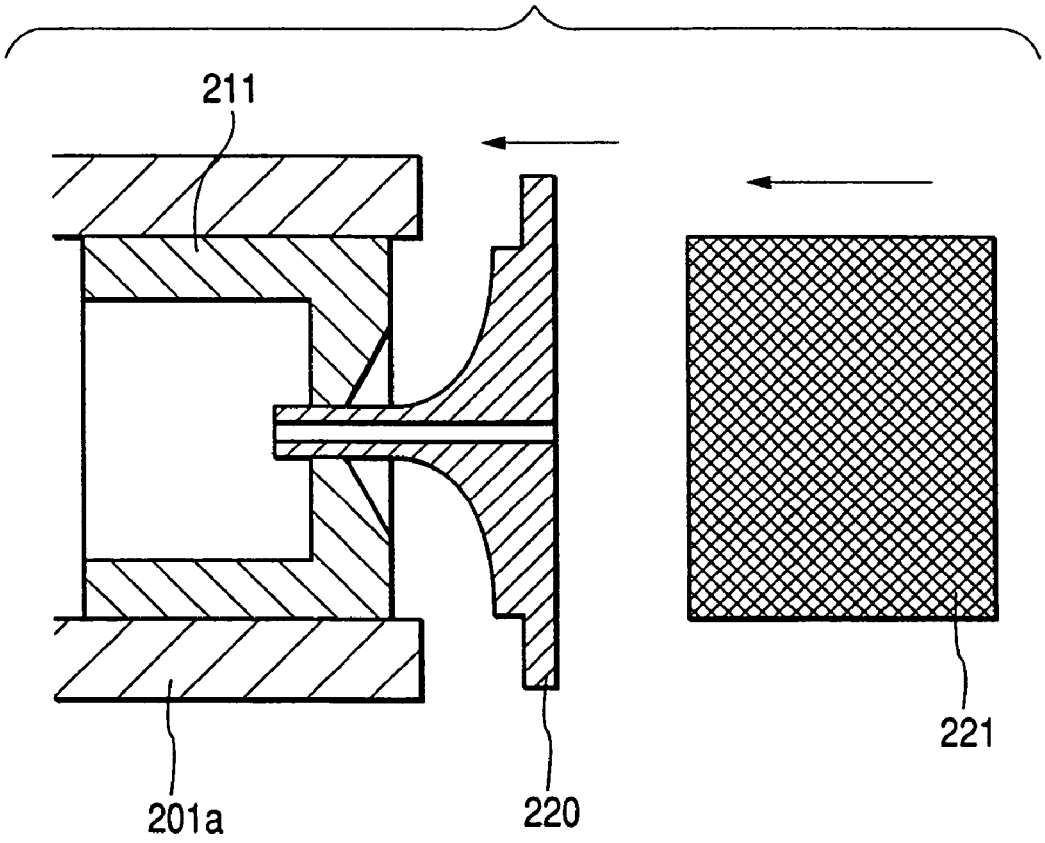
FIG. 13 is a longitudinal sectional view of a release cap of the present invention in which a base end is greater than a tip end.

Next, the release cap 220 in which a base portion is greater than a tip end portion will be fully explained with reference to FIG. 13.

Since the tip end of the release cap is inserted into the joint rubber 211 in the connector insertion portion 201*a* as the ink introduction portion of the ink jet head 201, a diameter of the tip end must be equal to or smaller than that of the connector. To the contrary, since the base portion is located out of the joint rubber 211 in the connector insertion portion 201*a*, the base portion has a diameter greater than that of the tip end and has increased strength in a shearing direction. Further, when the release cap is tapered from the tip end to the base end, the positioning of the cap in the connector insertion portion is facilitated.

With this arrangement, for example, due to the dropping or vibration, even if any load is applied to the base portion by a friction force between the absorbing body 221 and the cap, the release cap 220 is not broken and can securely hold the ink jet head 201.

Figure 14:
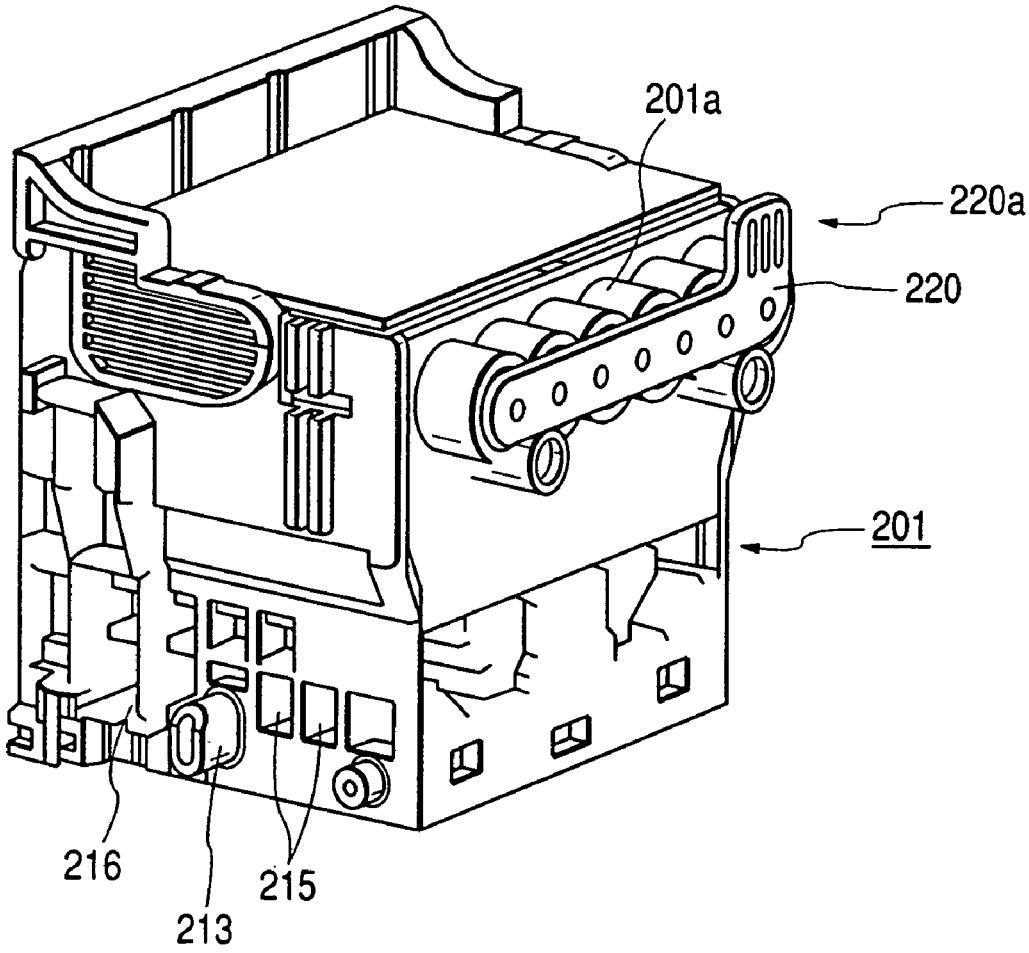
FIG. 14 is a perspective view showing the ink jet head and the release cap according to the present invention.

As shown in FIG. 14, the release cap 220 is provided with a protruded portion as a grip portion 220*a*. The grip portion 220*a* serves to facilitate removal of the release cap 220 when the ink jet head 201 is mounted on the carriage 2 and may have a size which can be gripped by the operator's fingers. In the illustrated embodiment, the grip portion has a size of about 10 mm×10 mm. Further, the grip portion 220*a* is required to be provided at a longitudinal end of the release cap 220 so that the release cap is removed from the connector insertion ports 201*a* while drawing the projections (tip ends) of the release cap 220 successively from a side of the grip portion 220*a*.

As shown in FIG. 14, the grip portion 220*a* is configured not to exceed the connector insertion portion 201*a* in a longitudinal direction of the release cap 220 (direction along which the connector insertion ports 201*a* are arranged). With this arrangement, under the dropping or vibration, the shock does not act on the release cap 220 from a lateral direction, thereby preventing damage of the cap. Similarly, regarding shock from an up-and-down direction, if the grip portion 220*a* exceeds the connector insertion portion 201*a*, a rotational force will act on the cap, with the result that the projections of the release cap 220*a* may be damaged. However, in the illustrated embodiment, since the grip portion 220*a* does not exceed the connector insertion portion 201*a*, even regarding the shock from the up-and-down direction, the rotational force can be suppressed. Preferably, a similar grip portion is also provided at an opposite end of the release cap 220 to disperse the load. However, in the illustrated embodiment, the grip portion is provided only at one end of the cap since the required strength can be obtained.

Second Embodiment

Figure 10:
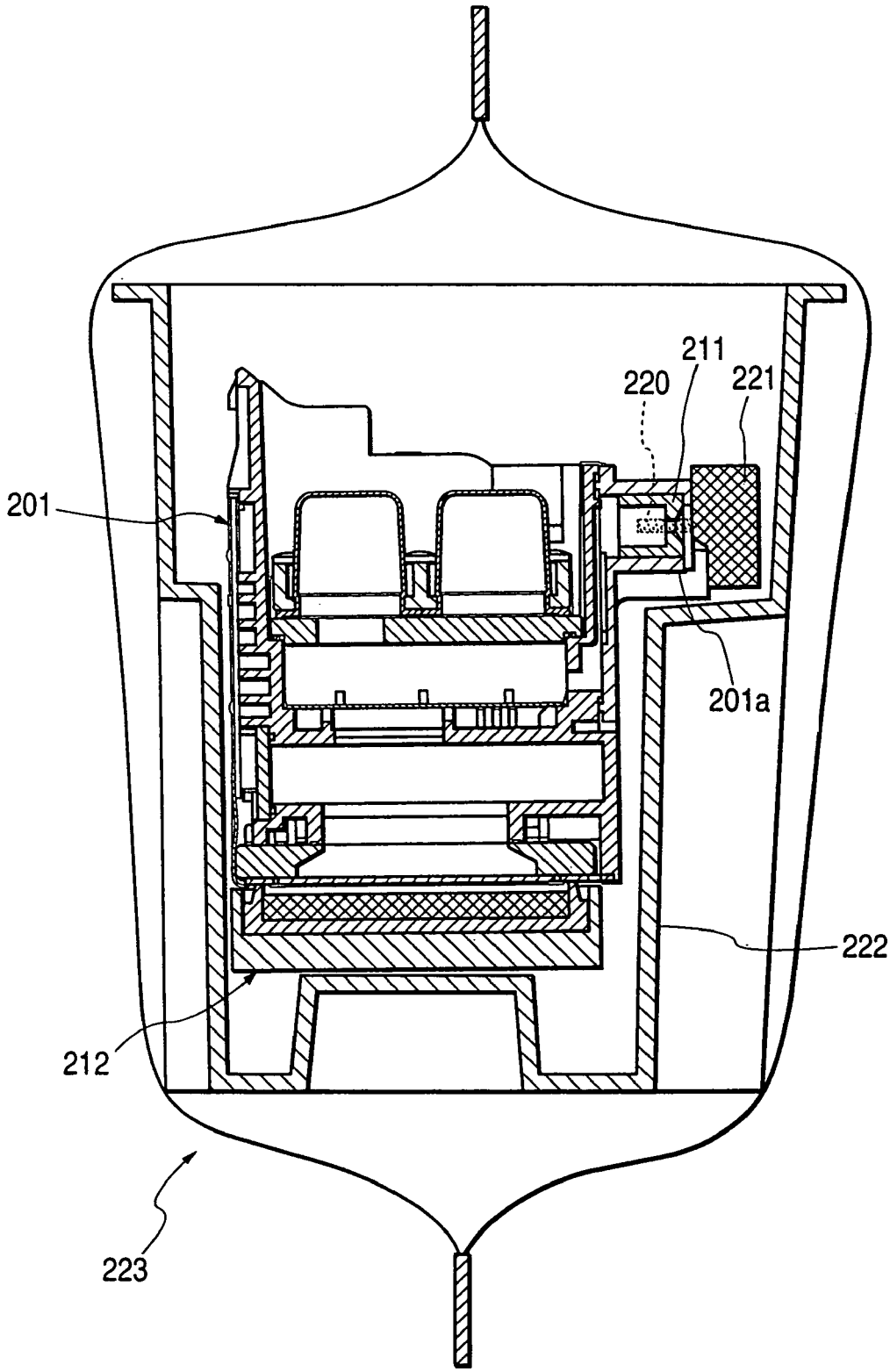
FIG. 10 is a longitudinal section view of a head, showing a storing structure for an ink jet head according to a second embodiment of the present invention.

Next, a second embodiment of the present invention will be explained. However, only a difference with respect to the first embodiment will be described. FIG. 10 is a longitudinal sectional view of a head, showing a storing structure for an ink jet head 201, according to the second embodiment of the present invention.

In the second embodiment, as shown in FIG. 10, an ink jet head 201 in a packed condition as explained in connection with the first embodiment is housed in a tray 222. The tray 222 is worked by molding of resin material such as polypropylene (PP) and serves to secure the ink jet head 201 during transportation. Furthermore, the tray also acts as a buffer member for reducing shock applied to the ink jet head 201, for example, under the dropping or vibration.

The tray 222 containing the ink jet head 201 in this way is housed in an aluminium bag 223 and an opening portion of the bag is sealed by heat seal. In this case, aluminium is best since it has very low gas permeability. However, material of the bag is not limited to aluminium so long as material having low gas permeability is used, for example, a laminated film can be used. With an arrangement as mentioned above, in comparison with a conventional system in which absorbing resins immersed by ink not including color material is housed together with the head in an aluminium bag for preventing evaporation or a conventional system in which a cap member not contacted with the face surface is provided and absorbing resin for absorbing ink not including color material leaked from the nozzles is housed in the cap member, a condition that a large amount of ink is directly contacted with air in the bag is not established. Namely, in the conventional cases, dews were apt to be formed in the bag due to environmental change (temperature change) and the formed dews corroded electrical connection between the head and the main body of the recording apparatus and created short-circuit between the terminals. However, in the illustrated embodiment, such inconveniences can be avoided.

Third Embodiment

Figure 15:
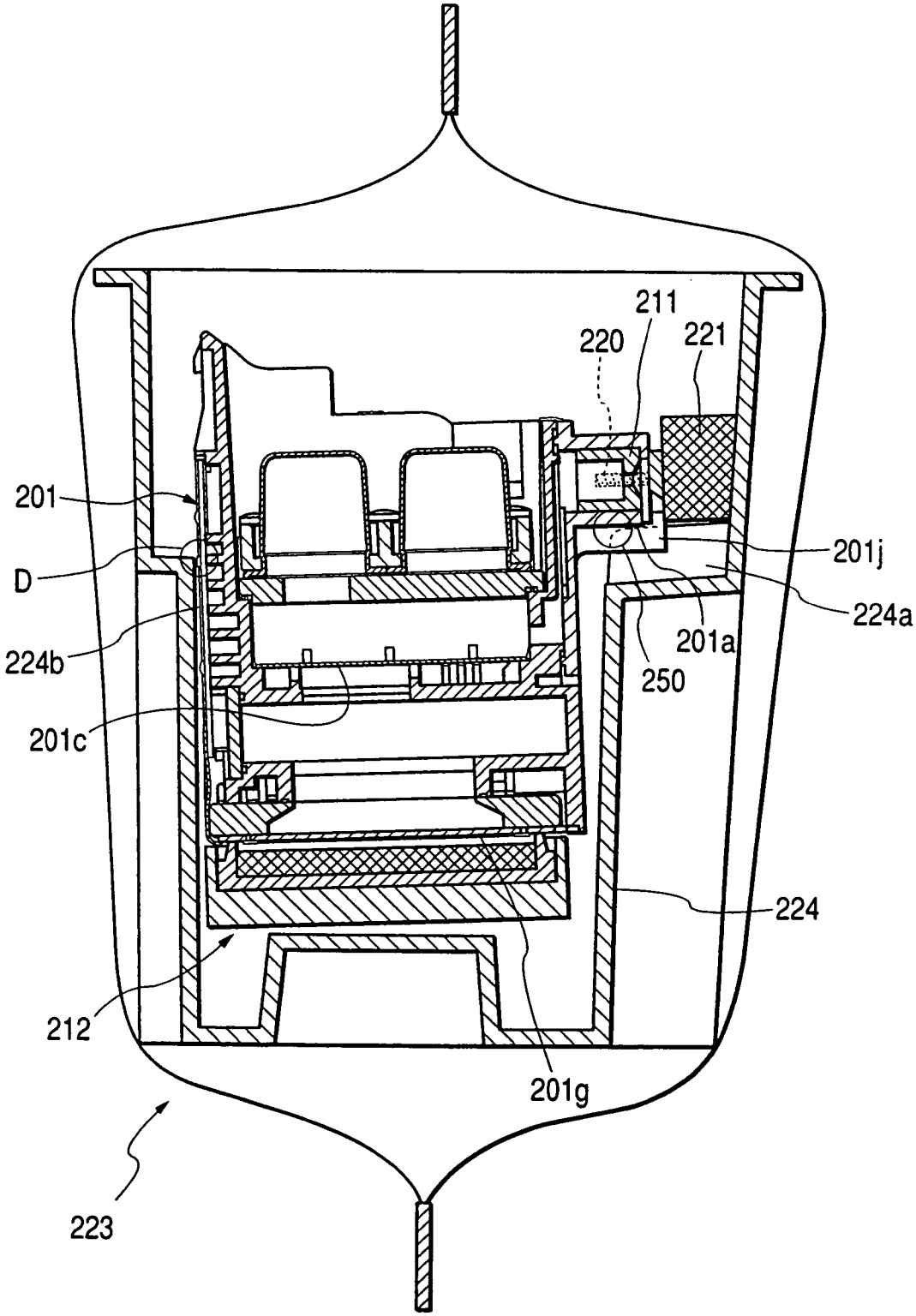
FIG. 15 is a longitudinal sectional view of a head, showing a storing structure for an ink jet head according to a third embodiment of the present invention.
Figure 16:
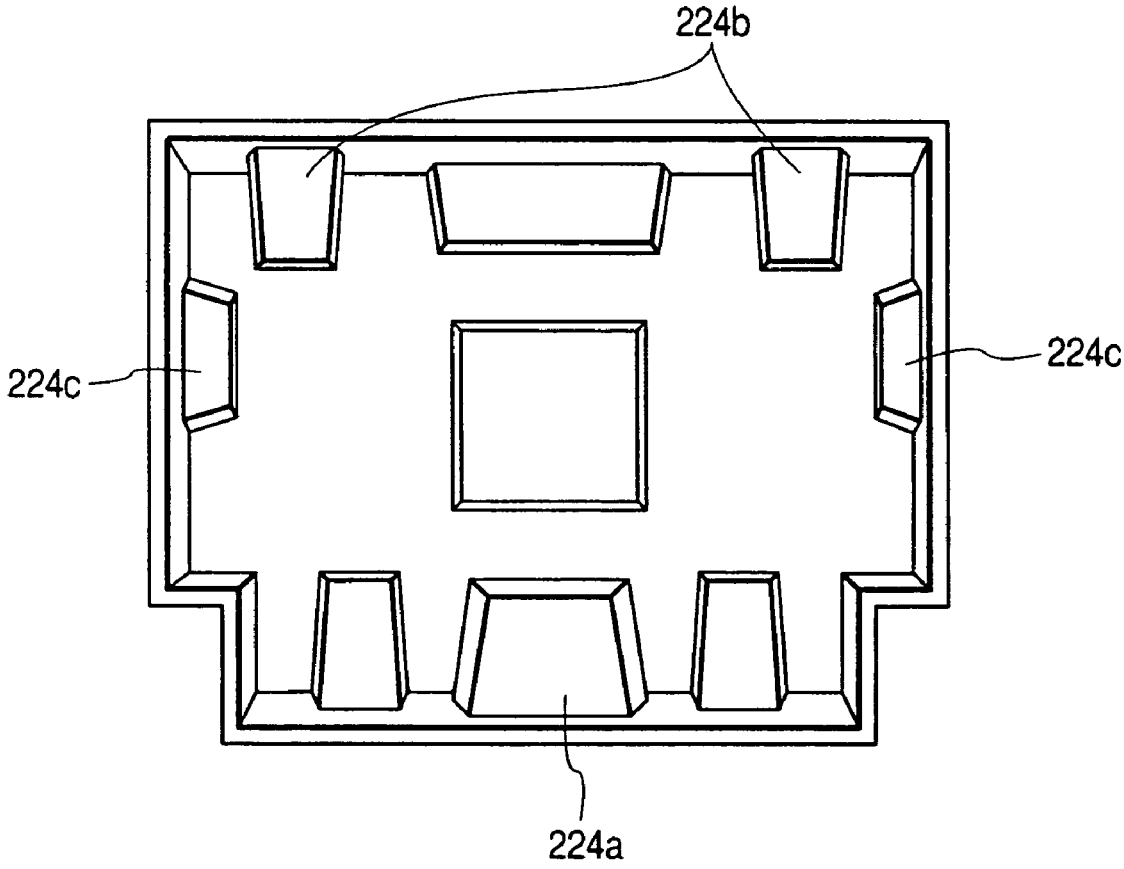
FIG. 16 is an upper view of a tray for storing the ink jet head according to the third embodiment of the present invention.

Next, different from the second embodiment, a storing structure for preventing the ink jet head 201 from being vibrated in the tray 224, according to a third embodiment of the present invention will be explained. However, only a difference with respect to the second embodiment will be described. FIG. 15 is a longitudinal sectional view of a head, showing a storing structure for an ink jet head 201, according to the third embodiment of the present invention. As shown in FIG. 16, liquid is held in the nozzles 201*g* and the filter 201*c*.

In the third embodiment, as shown in FIG. 15, an ink jet head 201 in a packed condition as explained in connection with the second embodiment is housed in a tray 224. Different from the tray 222, the tray 224 has a connector insertion port receiving portion 224*a*.

FIG. 16 is a top perspective view of the tray 224.

The ink jet head 201 (refer to C portion 250 in FIG. 15) in which the connector insertion portion thereof is lifted by the connector insertion port receiving portion 224*a* is urged against a head abutment portion provided in the tray 224. In this condition, by press-fitting an absorbing body 221 between the release cap 220 (or, slit-forming member) and the tray 224, the ink jet head 201 is fixed or secured. However, the absorbing body 221 may previously be installed in the tray 224 and then the ink jet head 201 may be fitted in the tray.

Further, both sides of the ink jet head 201 are held by head side holding portions 224*c* provided in the tray 224.

According to such a method, by securing the ink jet head 201 within the tray 224 in an inclined condition, the ink jet head can positively be secured in the tray having a tapered interior from bottom to top inherent to the molding technique.

Configurations, positions and/or number of the connector insertion port receiving portion 224, head abutment portion 224*b* and head side holding portions 224*c* in the illustrated embodiment may be changed from the illustrated ones so long as the same effect as that of the illustrated embodiment can be achieved.

The tray 224, containing the ink jet head 201 in this way is housed in an aluminium bag 223 and an opening portion of the bag is sealed by heat seal.

As mentioned above, according to the ink jet head storing structure of the present invention, when the ink not including color material is contained only in the nozzles of the ink jet head and the spaces in the head other than the nozzles are sealingly closed under the atmosphere of moisture of the ink not including color material, in comparison with the conventional ink jet head in which the ink storing space is filled with the ink not including color material, since leakage of the ink not including color material by the increase in the inner pressure of the head due to the environmental change does not occur and leakage of the ink not including color material due to difference in posture of the head can be prevented, an ink jet head having high reliability can be provided from the forwarding of the head to the receiving of the head by the user.

In order to sealingly close the spaces within the head under the atmosphere of moisture, the closed space may be given to the nozzle area by using the cap unit and the ink introduction portions of the head may be constituted by the slits. Furthermore, by housing the ink jet head on which the cap unit and the liquid absorbing bodies are mounted within the tray, shock to the ink jet head due to the dropping or vibration is suppressed.

Further, according to the cap unit of the present invention, since the liquid absorbing bosies in the cap unit are not contacted with the face surface in which the nozzle openings are formed, the nozzles of the ink jet head are not damaged and the wetting condition of nozzles can be maintained. Further, since the cap unit is provided with the positioning portion capable of being positioned with respect to the ink jet head, and the clip-shaped engagement portions capable of being once widened and then hooked on the ink jet head, the correct mounting and dismounting with respect to the head can be facilitated.

Further, according to the cap unit of the present invention, since the liquid absorbing bodies in the cap unit are not contacted with the face in which the nozzle openings are formed, the nozzles of the ink jet head are not damaged and the wetting condition of nozzles can be maintained. Even if the ink not including color material in the head is dropped from the face surface due to increase in inner pressure, since such ink is absorbed by the absorbing resins, the ink is not leaked out of the head, and the condition that the interior of the nozzles is filled with the ink or the saturated vapor is maintained. Further, since the ink is not leaked out of the cap, a bad influence is prevented from affecting upon the electrical connections.

What is claimed is:

1. A stored ink jet head comprising:

an ink jet head, wherein said ink jet head comprises a nozzle for discharging liquid, a liquid storing portion for storing the liquid to be supplied to said nozzle, and a liquid introduction portion for introducing the liquid into said liquid storing portion from a exterior, said liquid storing portion being divided into a first chamber communicated with said nozzle and a second chamber communicated with said liquid introduction portion by a filter;

a storing member to contain said ink jet head; and a cap for covering a nozzle face of said ink jet head in a non-contact state with respect to the nozzle face, wherein said liquid introduction portion is provided with an elastic member having a slit, wherein ink not including a color material is contained in said nozzle of said ink jet head and air is present in an area other than said nozzle in the ink jet head, and wherein air in said ink jet head is capable of moving between an interior of the ink jet head and an exterior side of said ink jet head through said slit.

* * * * *